US008032956B2

(12) United States Patent
Prokopenko et al.

(10) Patent No.: US 8,032,956 B2
(45) Date of Patent: Oct. 11, 2011

(54) MULTI-PHASE, HIGH ENERGY FLUSHING SYSTEM

(75) Inventors: Aleksandr Prokopenko, Bordentown, NJ (US); Michael Heaton, Beverley (GB); Pierpaolo Presiren, Pasian de Prato (IT); Antonio Floriduz, Zoppola (IT)

(73) Assignee: Ideal Standard International BVBA (BE)

( * ) Notice: Subject to any disclaimer, the term of this patent is extended or adjusted under 35 U.S.C. 154(b) by 1281 days.

(21) Appl. No.: 11/592,953

(22) Filed: Nov. 3, 2006

(65) Prior Publication Data

US 2007/0113331 A1 May 24, 2007

Related U.S. Application Data

(60) Provisional application No. 60/738,643, filed on Nov. 21, 2005.

(51) Int. Cl.
*E03D 11/02* (2006.01)
*E03D 11/18* (2006.01)

(52) U.S. Cl. ..... 4/425

(58) Field of Classification Search ..... 4/425, DIG. 3
See application file for complete search history.

(56) References Cited

U.S. PATENT DOCUMENTS 2,066,883 A * 1/1937 Groeniger ..... 4/425
3,224,013 A 12/1965 Tubbs
3,638,244 A 2/1972 Schmid et al.
3,648,297 A 3/1972 MacMillan
3,932,901 A 1/1976 Inui et al.
3,986,216 A 10/1976 Davis et al.
4,183,105 A 1/1980 Womack
4,185,337 A 1/1980 Sargent et al.
4,389,738 A 6/1983 Ando et al.
5,010,602 A 4/1991 Sargent et al.
5,052,060 A 10/1991 Makita et al.
5,073,994 A 12/1991 Sargent et al.
5,123,124 A 6/1992 Brower
5,133,089 A 7/1992 Tsutsui et al.
5,228,146 A * 7/1993 Martell ..... 4/DIG. 3
5,305,475 A * 4/1994 Jaeckels et al. ..... 4/325
5,457,822 A 10/1995 Klammsteiner
5,502,845 A 4/1996 Hayashi et al.
5,692,250 A 12/1997 Oldfelt et al.
5,715,544 A 2/1998 Huffman et al.
6,000,070 A 12/1999 Bonin (Continued)

OTHER PUBLICATIONS

Kohler, "Trocadero Powerlite Toilet" production specification, pp. 1 and 2.

(Continued)

*Primary Examiner* — Lori Baker
(74) *Attorney, Agent, or Firm* — Baker & McKenzie LLP

(57) ABSTRACT

The present invention provides a method of operating a flushing system for efficient waste removal from and cleaning of a toilet bowl. In the disclosed method, a flushing system is provided that includes a pumping means having each of a rim diverter means and a jet diverter means in fluid communication therewith; a sensor means; a control means; a switching means; and a spray means. Activation of the switching means initiates at least a single flush schedule that comprises the steps of initiating operation of the pumping means; opening the jet diverter means for delivery of water to a jet delivery means in fluid communication therewith; subsequently closing the jet diverter means and simultaneously opening the rim diverter means; and directing water from the rim diverter means to a toilet rim in fluid communication therewith for terminal delivery of the water through the spray means.

25 Claims, 15 Drawing Sheets

U.S. PATENT DOCUMENTS

| | | | | |
|---|---|---|---|---|
| 6,115,853 | A | 9/2000 | Shibata et al. | |
| 6,279,174 | B1 | 8/2001 | Candusso | |
| 6,332,229 | B1 | 12/2001 | O'Malley et al. | |
| 6,401,270 | B1 | 6/2002 | Moore | |
| 6,467,101 | B1 | 10/2002 | Artola | |
| 6,470,505 | B1 | 10/2002 | Boisvert | |
| 6,588,026 | B2 | 7/2003 | Meier et al. | |
| 6,728,975 | B2 | 5/2004 | Han | |
| 2003/0088910 | A1 * | 5/2003 | Hidetaka et al. | 4/425 |
| 2004/0040080 | A1 | 3/2004 | Prokopenko et al. | |
| 2005/0119764 | A1 | 6/2005 | Martin et al. | |

OTHER PUBLICATIONS

Kohler, "Purist Hatbox Toilet" production specification, pp. 1 and 2.

Urban Edge, "Toilets", www.urbanedge.org/green-housing, Sep. 28, 2006, 2 pgs.

"Toilets: Comfortable and Efficient", Consumer Reports, Aug. 2005, 1 pg.

Glenn Haege, "A Scorecard is Needed to Pick the Best-Flushing Toilet", Detnews.com, Sep. 9, 2006, 2 pgs.

* cited by examiner

MULTI-PHASE, HIGH ENERGY FLUSHING SYSTEM

This application claims the priority of U.S. Provisional Application No. 60/738,643, filed Nov. 21, 2005, and incorporated by reference herein.

FIELD OF THE INVENTION

The present invention is directed to operation of a toilet having multi-phase, high energy flushing operations for optimum bowl cleanliness. In particular, the present invention is directed to a method of operating a flushing system that reliably and predictably removes a maximum load of liquid and solid waste from a toilet bowl and effectively removes stains from a bowl surface thereafter. The present invention method employs a flushing system that accomplishes these functions without clogging of the toilet exhaust pipe and with minimal expenditure of water and energy.

BACKGROUND OF THE INVENTION

The excessive consumption of potable water remains a dilemma for water agencies, commercial building owners, homeowners, residents and sanitaryware manufacturers. An increasing global population has negatively affected the amount and quality of suitable water. In response to this global dilemma, many local and federal authorities have enacted regulations that reduce the water demand required by toilet flushing operations. In the United States, for instance, government agencies that regulate water usage have gradually reduced the threshold for fresh water use in toilets, from 7 gallons/flush (GPF)(26.5 liters/flush (LPF)) prior to the 1950s to 5.5 GPF (20.8 LPF) by the end of the 1960s to 3.5 GPF (13.3 LPF) in the 1980s. The National Energy Policy Act of 1992 now mandates that toilets sold in the United States can only use 1.6 GPF (6 LPF) (see "Toilets", www.urbanedge.org/green-housing). Other countries through North and South America, Europe, Asia and Australia have enacted similar restrictions in recognition of global water conservation objectives.

In the sanitary industry, however, a toilet must successfully perform two operations within prescribed legislative limits for water usage. The toilet must not only achieve unimpeded removal of all waste from a toilet bowl, but also effect complete removal of surface markings from the bowl interior. Even with water usage restrictions, consumers expect successful completion of both functions without the need for successive, redundant flushes and/or redundant brushing and scrubbing.

Prior to inception of water restriction regulations, contemporary toilets employed principals of gravity to complete these functions. Such toilets operated essentially by pouring a large amount of water into the bowl and relying upon the inherent low-pressure flow for sufficient operation thereof. The significant reduction of available flush water, however, prompted radical design changes to then-existing toilets designs and impeded the ability to achieve an effective flush. For example, reduction of flush water volume from 3.5 gallons (10 liters) to 1.6 gallons (6.0 liters) in the United States revealed the poor hydraulic design inherent in existing toilets and forced sanitaryware manufacturers to reduce the diameter of the toilet exhaust pipe by up to 1.5" (3.8 cm). This design modification produced a funnel whereby the toilet aided the siphon function. The reduced exhaust pipe parameter, however, exacerbated clogging and required multiple flushes for complete elimination of waste and surface markings from the bowl interior, thus eliminating any water reduction benefits.

Although the above problems are not applicable to gravity-fed toilets, water restriction regulations also incurred problems in Europe, where such gravity-fed, non-siphoning toilets are configured for installation in floor or wall outlets (thereby ensuring compliance with regional codes). Unlike American designs, such non-siphoning configurations typically have deep bowls, small water spots and enhanced exhaust pipe diameters from about 2.5" (6.4 cm) to about 3" (7.6 cm), inclusive, that are not prone to clogging. The small water spot, however, increases the dry surface area of the ceramic bowl that is exposed to soil. This increased surface area inhibits bowl cleanliness and exacerbates the need for consistent manual bowl cleansing.

Sanitaryware manufacturers, learning from their initial mistakes, thereafter made significant progress in toilet design and operation to perform the waste removal and cleaning functions described hereinabove. Most manufacturers employed new features in these designs, namely, a very powerful jet that helped to arrange the siphon at a larger exhaust diameter (in siphoning toilet models typically found in the united States and Asia); and a constant diameter exhaust pipe with almost no restrictions (in siphoning and non-siphoning models). In the United States, for instance, multiple toilet models emerged that incorporated improved hydraulic design, often fed by 3" (7.6 cm) discharge valves in the toilet tank to create a powerful jet. Such toilets remove a demonstrably larger load within the 1.6 GPF (6 LPF) water limit when compared to their predecessors (see, for example, U.S. Pat. No. 5,123,124 for "Automatic, Self-Cleaning, Water-Saving Toilet System"; U.S. Pat. No. 6,115,853 for "Toilet Bowl"; U.S. Pat. No. 6,332,229 for "Automated Flap and Cup Cleaner Water-Saving Toilet"; and U.S. Pat. No. 6,470,505 for "Water Efficient Toilet").

A common drawback of conventional gravity-force dynamic toilets is the removal of the majority of water by a strong jet during the flush function. The powerful jets employed thereby use a significant portion of available water for the flush, leaving a minimal amount of water for a rim wash and correspondingly little capability for sufficient cleaning of the bowl interior. Such toilets additionally have problems with consistent excess noise during use and often incur uncomfortable splashing of toilet water. It is therefore desirable to explore other energy sources that exhibit enhanced toilet performance and water conservation benefits.

Line pressure as an energy source provides simple, reliable performance without the need for electricity and without the need for a tank (if direct flow from a 1" (2.5 cm) line is used). Conversely, line pressure is not immediately available in many markets (and in Europe, legislation exists to prevent the use of line pressure). In addition, line pressure as an energy source requires use of a heavy and expensive water control valve with dependence on inherent line pressure and undesirable noise and water flow characteristics. This type of energy source is not compatible with residential applications where the line is ½" (1.3 cm).

In the alternative, pressure accumulators are used for toilets to provide sufficient flushing performance without the need for electricity. These toilets require an additional tank and exhibit dependence upon preexisting line pressure. Because the water pressure changes significantly during discharge (producing high water pressure at the initiation of water discharge yet low water pressure at the end of such discharge), the average pressure during the flush cycle is approximately half of the line pressure or the pressure regulator pressure. The need for a pressurized vessel results in excessive noise and water flow control, presenting the consumer with a sub-optimal solution (see "Toilets: Comfortable and Efficient", Consumer Reports, August 2005).

Both pressure line and pressure accumulator systems simultaneously direct water to a toilet rim and jet simultaneously (using either option still requires optimum distribution of water flow between the jet and the rim, although hydraulic water control devices devised for this purpose remain complicated, expensive, inflexible and incapable of proper water flow distribution.). The pressurized jet pushes out the sump load quickly, and this event is comparatively silent because the energy of the jet is damped by water in the sump. When the sump becomes empty, pressurized water shoots out of the jet into the air, thereby creating a high decibel noise (the noise level in pressure assisted toilets is about 85 dB, slightly louder than the 80 dB noise level of a conventional vacuum cleaner, as compared with a noise level at or about 78 dB for conventional gravity toilets). To prevent such noise, the jet flow must be stopped when the sump is empty. Excessive noise is an important factor in toilet selection, as installation of noisy toilets is limited to public places and not appropriate for private residences or places of relaxation (i.e., hotels, spas, hospitals, residential care facilities, etc.).

In addition, pressurized jets in these systems create splashing of water that has not yet evacuated the bowl. As a consequence, splashing on the rim creates an unhygienic condition and also fails to adequately remove surface markings of waste from the bowl interior.

Flexible electrical controls and electric pumps are an alternative to line pressure for energizing toilets. Despite the fact that toilets with electric pumps have been known for some time (see, for instance, U.S. Pat. Nos. 3,986,216; 3,932,901; 4,185,337 and 5,010,602, the disclosures of which are incorporated by reference herein), few toilets currently on the market have an electric pump. Examples of this type of toilet include one-piece embodiments with a very low tank within which the pump resides and induces flow (see, for example, the product specification for Kohler's "Trocadero" toilet) and a tankless toilet that hides water storage in a shroud beneath the tank (see, for example, the advertisement and product specification for Kohler's "Purist Hatbox" toilet). In the latter example, a pump pushes water into the jet and rim, and electric and water supply lines disposed beneath the toilet support surface enter the toilet from a bottom portion thereof. Such compact construction is aesthetically pleasing and accommodates flushing under a strong pressurized jet action. This example, however, lacks proper timing and distribution control of water between the rim and the jet. The result is a weak bowl wash due to the lack of sufficient water delivery at the rim. In addition, splashes caused by the jet escape the bowl interior, causing likely discomfort to the user. The jet continues to run when the sump is already empty, and excessive noise is prevalent during the flushing action.

Conventional toilet designs still use a significant amount of water to complete a flush cycle, especially in consideration of contemporary water conservation efforts. Applicant of the instant application has addressed the need for powerful, cleansing flushes in 1.6 GPF/6.0 LPF embodiments (see Applicant's U.S. Pat. No. 6,728,975 and Applicant's pending U.S. application Ser. No. 10/231,977, the disclosures of which are incorporated by reference herein). Applicant's disclosures provide a toilet with an exhaust pipe having a diameter of about 2 and ⅜", thereby obviating most clogging conditions. In the commercial embodiment of Applicant's disclosed toilet, 1.2 gallons (4.5 liters) of water is discharged from the tank in about 0.7 seconds, and a complete flush takes about 3 seconds. This device may be integrated with electronic timers integrated into a control circuit, such timers being more adjustable and cost effective than analog mechanical flow control devices.

Applicants have observed, however, that it is desirable to provide a toilet having an improved flushing system and operating method therefor, such flushing system using an alternative energy means with minimal water consumption and without any detriment to flushing performance. Such a flushing system operating method is desirably employed in a plurality of siphoning and non-siphoning toilet configurations for global applications (desirably using a water volume at about or below 1.6 gallons (6 liters)). Such an operating method should ensure load removal from the sump with minimal flushing noise but with comprehensive bowl cleaning without the need for plungers and/or brushes. The employed flushing system can be readily installed in cooperation with any preexisting water supply line (including ½" (1.3 cm) diameter residential water supply lines). The desired flushing system configuration will permit compact toilet designs to facilitate installation and maintenance thereof and affordability for a wide range of commercial and residential consumers. By using minimal water amounts to achieve an effective flush and thereby maintain optimal bowl cleanliness, such an operating method desirably reduces consumption of potable water without compromising sanitation.

SUMMARY OF THE INVENTION

It is an advantage of the present invention to provide a flushing system operating method wherein a flushing system uses electricity to energize water and precisely control water flow, thereby elevating flushing and cleaning performance over that of conventional gravity force toilets.

It is also an advantage of the present invention to provide a flushing system operating method that precisely times jet flow and rim flow during the flush cycle. Existing electronic flushing systems energize water flow that is suboptimal for waste removal and cleanliness within water conservation limits. To address this drawback, the present invention (and toilets employing the present invention) employs effective flow control elements (i.e., rim diverter means and jet diverter means) to switch water flow from a pump to the rim and/or jet. The present invention further employs an electrical pump that is sufficiently large enough to achieve strong flushing performance within prescribed water use limits yet sufficiently small enough for integration in reasonable overall dimensions. Such pump technology is commercially available and successfully operates within the power supply limit of available electrical outlets.

It is another advantage of the present invention to provide a flushing system operating method wherein the flushing system does not depend upon water line pressure and can be used with water supply lines of any size for both residential and commercial applications.

It is still another advantage of the present invention to provide a flushing system operating method wherein the flushing system is readily employed in toilets having a compact configuration that are readily installed, maintained and transported. The pump used in the flushing system pushes water at high pressure, thereby obviating the need for a storage tank above the toilet bowl. Elimination of the elevated tank provides more valuable space in the bathroom, allowing greater freedom of design (both aesthetic and functional design, including the integration of functional toilet subsystems) for both the toilet and its surrounding environment.

It is further an advantage of the present invention to provide a flushing system operating method that effects enhanced transport of liquid and solid loads using a reduced water volume compared with existing 1.6 gallon (6.0 liter) gravity force toilets. This is accomplished in both siphoning and non-siphoning toilet models.

It is still a further advantage of the present invention to provide a flushing system operating method wherein water flow control is a primary benefit of system operation.

In accordance with these and other advantages, the present invention provides a method of operating a flushing system for efficient waste removal from and cleaning of a toilet bowl. The target toilet bowl has a bowl with a rim disposed at a top bowl extent and a sump defined in a bottom bowl extent that leads to a discharge pipe. The sump has a jet delivery means proximate thereto, and the bowl is in fluid communication with a water storage tank having a first predetermined volume of water stored therein.

In the present inventive method, a flushing system is provided that includes a pumping means for delivering water from a water storage vessel such as a toilet tank to at least one of a rim diverter means and a jet diverter means in fluid communication therewith; a sensor means that detects when the water is at a volume below the first predetermined volume and produces a signal in response thereto; a control means having at least one timer integral therewith for controlling at least one of the pumping means, rim diverter means and jet diverter means in response to the sensor means; a switching means for initiating at least a single flush schedule for removal of water and waste from the bowl upon actuation thereof; and a spray means provided at or adjacent the toilet rim for delivering water to the bowl. The first predetermined water volume is at or less than about 1.6 gallons (6.0 liters). The rim diverter means and the jet diverter means comprise at least one solenoid valve performing both functions, although the present invention is not limited to such valve means for successful performance thereof.

Activation of the switching means initiates the at least one single flush schedule, which includes the steps of initiating operation of the pumping means; opening the jet diverter means for delivery of water to a jet delivery means in fluid communication therewith, subsequently closing the jet diverter means upon draining of water from the sump and simultaneously opening the rim diverter means; and directing water from the rim diverter means to the toilet rim in fluid communication therewith for delivery of water through the spray means. The spray means comprises at least one spray aperture that desirably forms part of a predetermined pattern of spray apertures disposed at or adjacent the toilet rim. In the alternative, the spray means comprises at least one spray nozzle disposed at or adjacent the rim and directing water into the bowl. Either spray means cleanses all waste and markings from the bowl interior and replaces the water in the sump.

In operation, the present invention executes a water flow schedule wherein a strong jet spray means first pushes water and waste out of the sump. Next, the pressurized water is directed precisely into the rim. To achieve enhanced pressure wash of the bowl, spray means are provided to which pressurized water is delivered through a conduit. This cleaning system is located in the rim, such that, when the bowl is empty, sprays from the spray means can reach the bowl walls directly and clean them well. Rim water will therefore not only clean the bowl but will also refill it and restore the water trap. The water therefore has two uses (i.e., washing and replenishment) within one or more cycles during which at or less than 1.6 gallons (6/0 liters) of water is cumulatively consumed.

BRIEF DESCRIPTION OF THE DRAWINGS

FIG. 11(*b*) shows an enlarged partial view of a water flow path through a toilet rim portion having a plurality of spray nozzles disposed therein.

FIG. 12(*b*) shows a rim water delivery path achieved upon securement of a rim water delivery conduit to a bifurcated connector.

FIG. 13(A) shows a single flush schedule for liquid and/or light solid waste removal.

FIG. 13(B) shows a modification in the single flush schedule wherein there is initial rim action prior to emptying of the sump and the duration of a terminal rim action is extended subsequent to emptying of the sump.

FIGS. 13(C) and 13(D) show an economy dual flush schedule for solid waste and/or paper removal from a non-siphoning bowl.

FIGS. 13(E) and 13(F) show a full dual flush schedule for solid waste and/or paper removal from a non-siphoning bowl.

FIG. 13(G) shows a modification in the full dual flush schedule wherein the difference is the extended duration of the last rim action subsequent to emptying of the sump.

DETAILED DESCRIPTION OF THE PREFERRED EMBOIDMENTS

Figure 5:
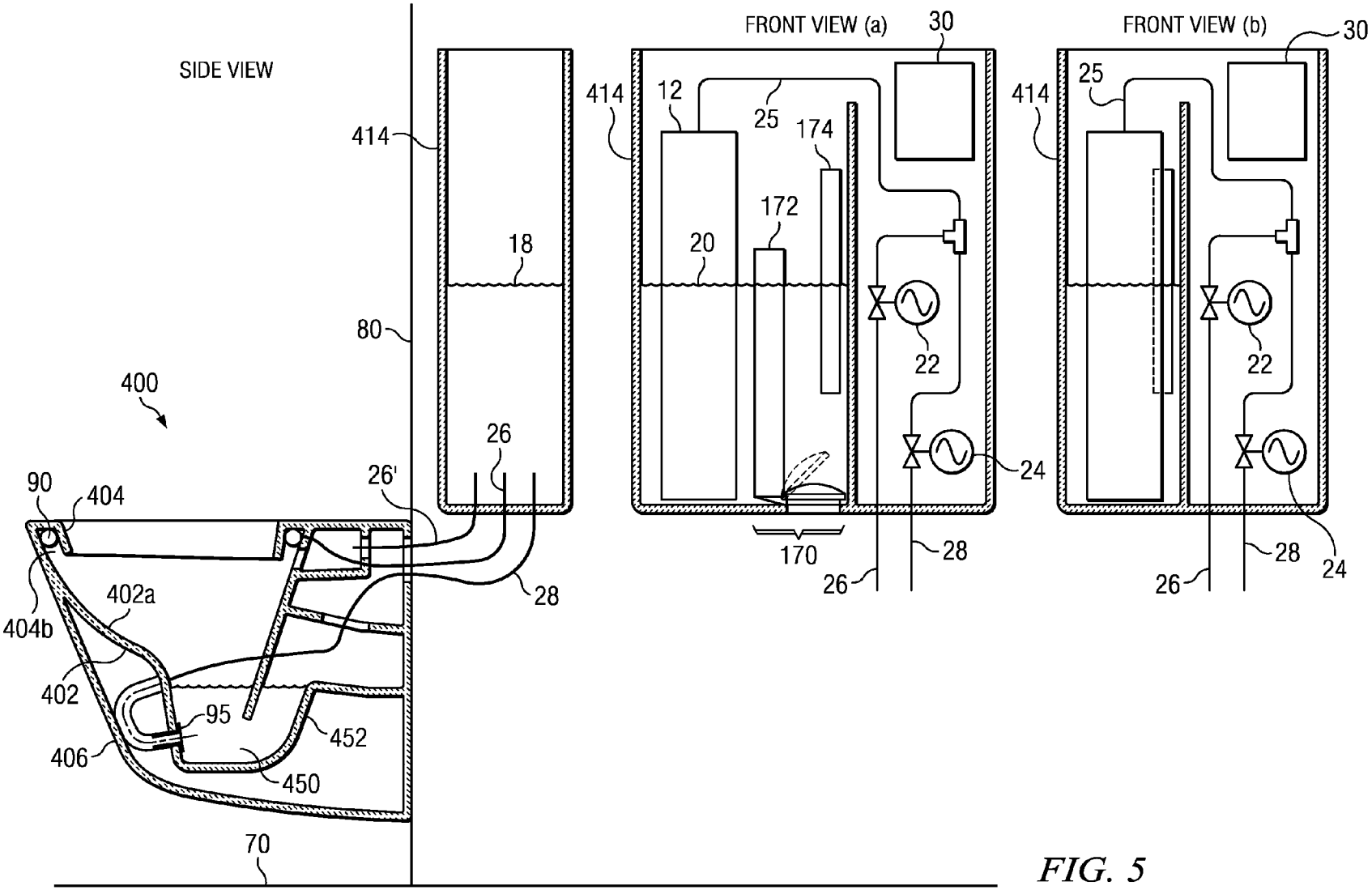
FIG. 5 shows a non-siphoning wall-hung toilet with a wall discharge and a tank disposed behind the wall that houses a flushing system of the present invention.
Figure 6:
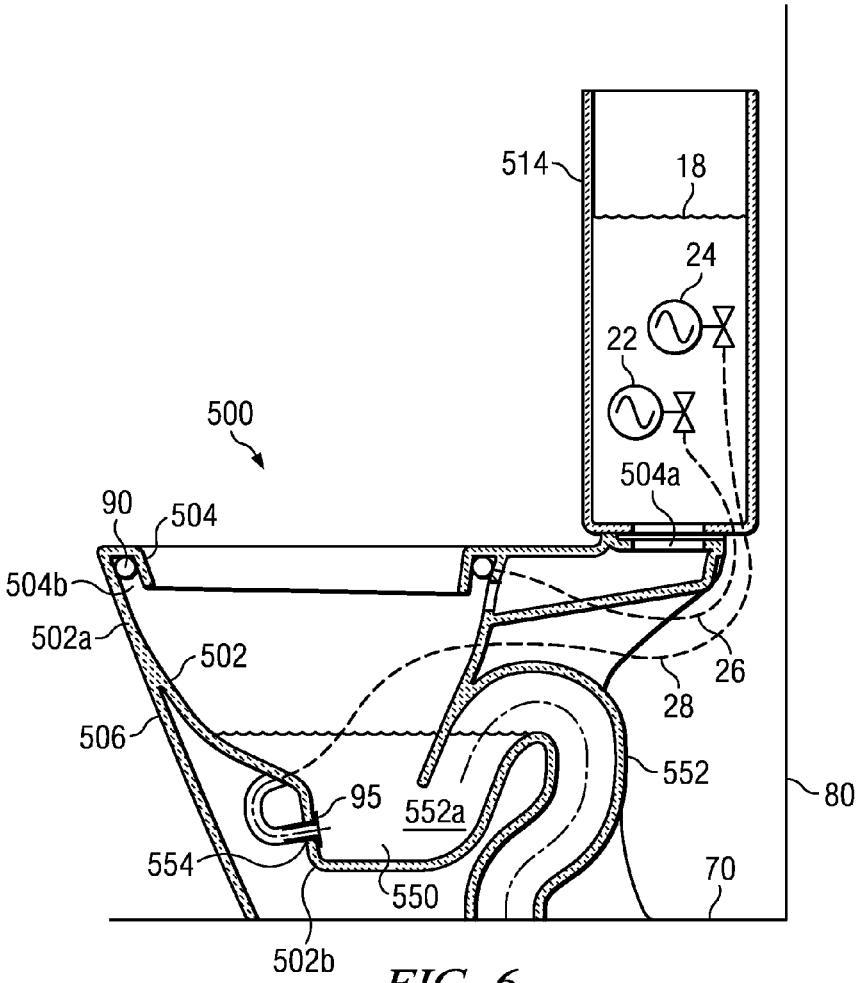
FIG. 6 shows a siphoning toilet with a floor discharge and an above-bowl tank housing a flushing system of the present invention.

Referring further to the figures, wherein like numerals identify like elements, a multi-phase high energy flush system 10 is shown in FIG. 6. FIGS. 2 to 10 show adaptations of system 10 in multiple toilet embodiments.

Figure 1:
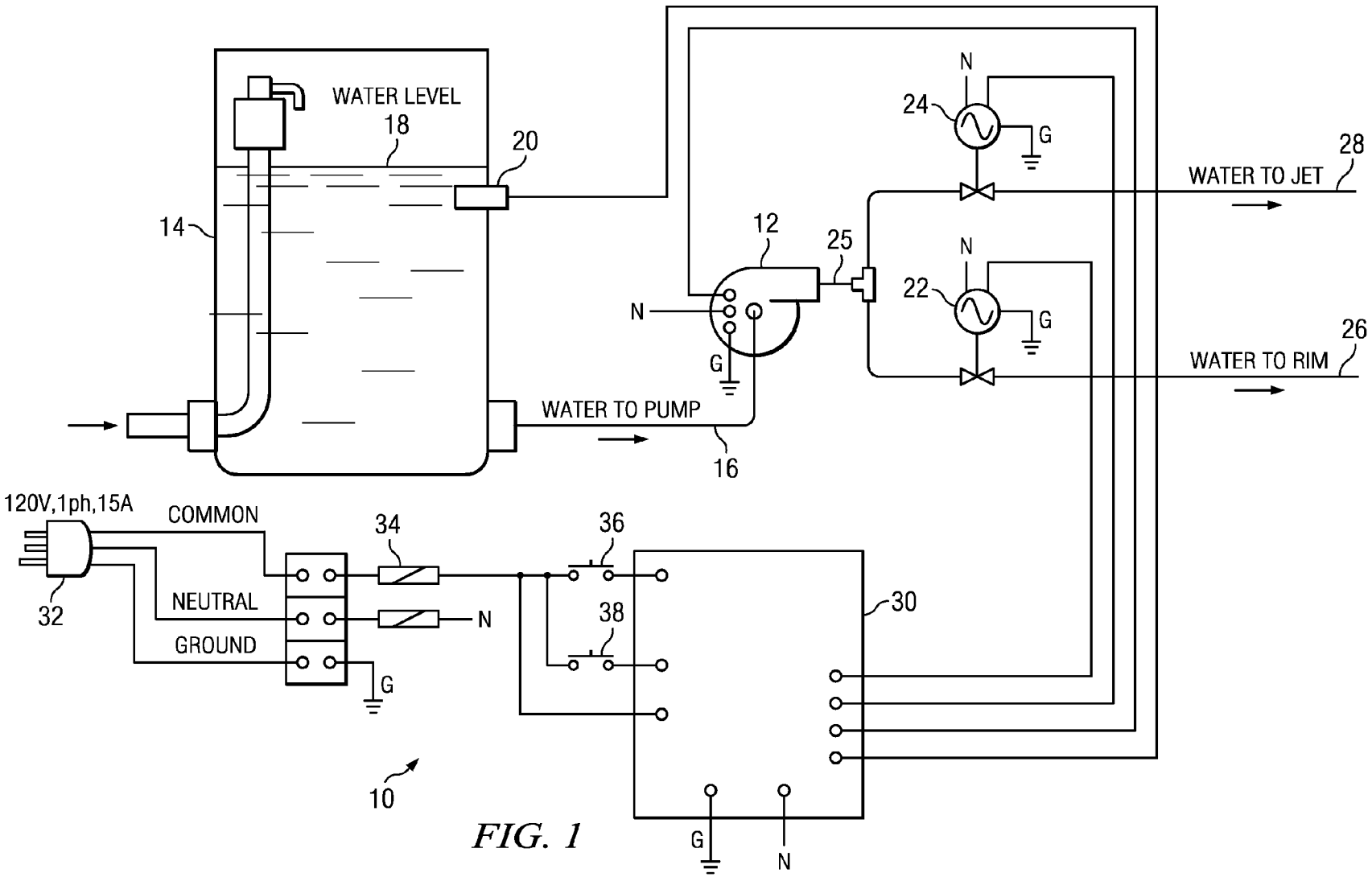
FIG. 1 shows a multi-phase, high energy flushing system of the present invention.

Referring to FIG. 1, system 10 includes an electric pump 12 that is in fluid communication with a water storage tank 14 via a tank water delivery conduit 16 therebetween. Tank 14 is filled to a predetermined water level 18 (typically at or less than about 1.6 gallons (6.0 liters)) detected by a liquid level sensor 20 that senses when the water in tank 14 falls below water level 18. It is important to note that a strong pump operates more quickly than a preexisting water supply line. To ensure proper pumping action, it is therefore important that the full volume of water designated by water level 18 be stored in tank 14 prior to operation of pump 12. Liquid level sensor 20 therefore provides a safety means to ensure automatic pump shutoff and prevent the pump from running dry.

In the present invention, either of a submersed pump (shown in FIGS. 2, 3, 4, 5, 6, 9 and 10) or a non-submersed pump (shown in FIGS. 7 and 8) may be used with system 10. In the event of leaking, a submersed pump will return water to the tank and thereby prevent deleterious water damage to the floor and/or wall thereadjacent. A non-submersed pump (shown, for example, in FIG. 7) allows placement of the tank outside of the wall and beneath the bowl for advantageous installation and maintenance properties.

Pump 12 communicates fluidly with each of a rim diverter means 22 and a jet diverter means 24 via a pump water delivery conduit 25. Each of rim diverter means 22 and jet diverter means 24 is shown herein as a single solenoid valve, however, it is understood that multiple solenoid valves, diverter valves or comparable valve means may be used without departing from the scope of the present invention (for instance, one valve means can effect both rim diversion and jet diversion functions). Incorporation of such valves is dependent on the type and number of toilets being served by system 10 (i.e., a single toilet within a residence or hotel room versus multiple toilets within a public facility). Rim diverter means 22 delivers water to a rim water delivery conduit 26 that establishes fluid communication with a toilet rim (such as rim 104 shown in FIG. 2) as further described hereinbelow. Jet diverter means 24 similarly delivers water to a jet water delivery conduit 28 that establishes fluid communication with a jet as further described hereinbelow.

An electronic controller 30 having one or more timers integral therewith controls actuation of pump 12 and diverter means 22 and 24. Power to controller 30 (and system 10) is provided by a conventional power supply member 32 that electrically communicates with a standard power supply (fuses 34 limit electrical current as is known in the art). An optional wall may be provided in the tank to separate electronic controller 30, rim diverter means 22 and jet diverter means 24 from the water stored therein (it is understood that electronic controller 30 is desirably provided in a waterproof housing as is known in the art for optimum safety and reliability). Electronic controller 30 is selected from one of a plurality of control devices that are well known to effect timing and communication of relevant information (via sensor detection or equivalent means).

A switching means comprising one ore more activation switches may be provided that correspond to the desired flush cycles. As shown, a single flush activation switch 36 initiates at least one single flush cycle for removal of a liquid or light sold load, and a dual flush activation switch 38 initiates economy and full dual flush cycles for removal of sold waste and heavy sold waste, respectively. The switching means is actuated by contact with an actuatable member (i.e., a trip lever, handle, button or any equivalent thereof) or via touchless means as are well known in the art (including but not limited to, voice recognition, heat sensor, motion sensor, infrared sensor, radio frequency and equivalents thereof)(see US Publication No. 2005/0119764 for a "Suite of Configurable Products Which Can be Configured During Fitting, Configuration Tool and Configuration Process for Such Products", the entire disclosure of which is incorporated by reference herein).

Diverter means 22 and 24, and electronic controller 30, can be disposed inside the water storage tank (as shown in FIGS. 2, 3, 5, 6 and 10) or outside the tank (as shown in FIGS. 4, 7, 8 and 9). For a toilet with a tank exposed above the bowl, the location of the diverter means and the electronic controller in the tank enables ready access to these parts for maintenance and replacement. This configuration also eliminates the need for a removable skirt or removable side panels around the bowl. For a toilet with a tank behind the bowl outside the wall (or with the tank in the wall), it is preferable to place easily accessible diverter means and electronic control means outside the tank and behind a removable skirt or removable side panels around the bowl. For a wall-hung toilet with a tank in the wall and furnished with a cover on the wall that provides ready access to all components of the system in wall, it is more convenient to place the diverter and control means outside the tank (see, for instance, FIG. 10).

Figure 2:
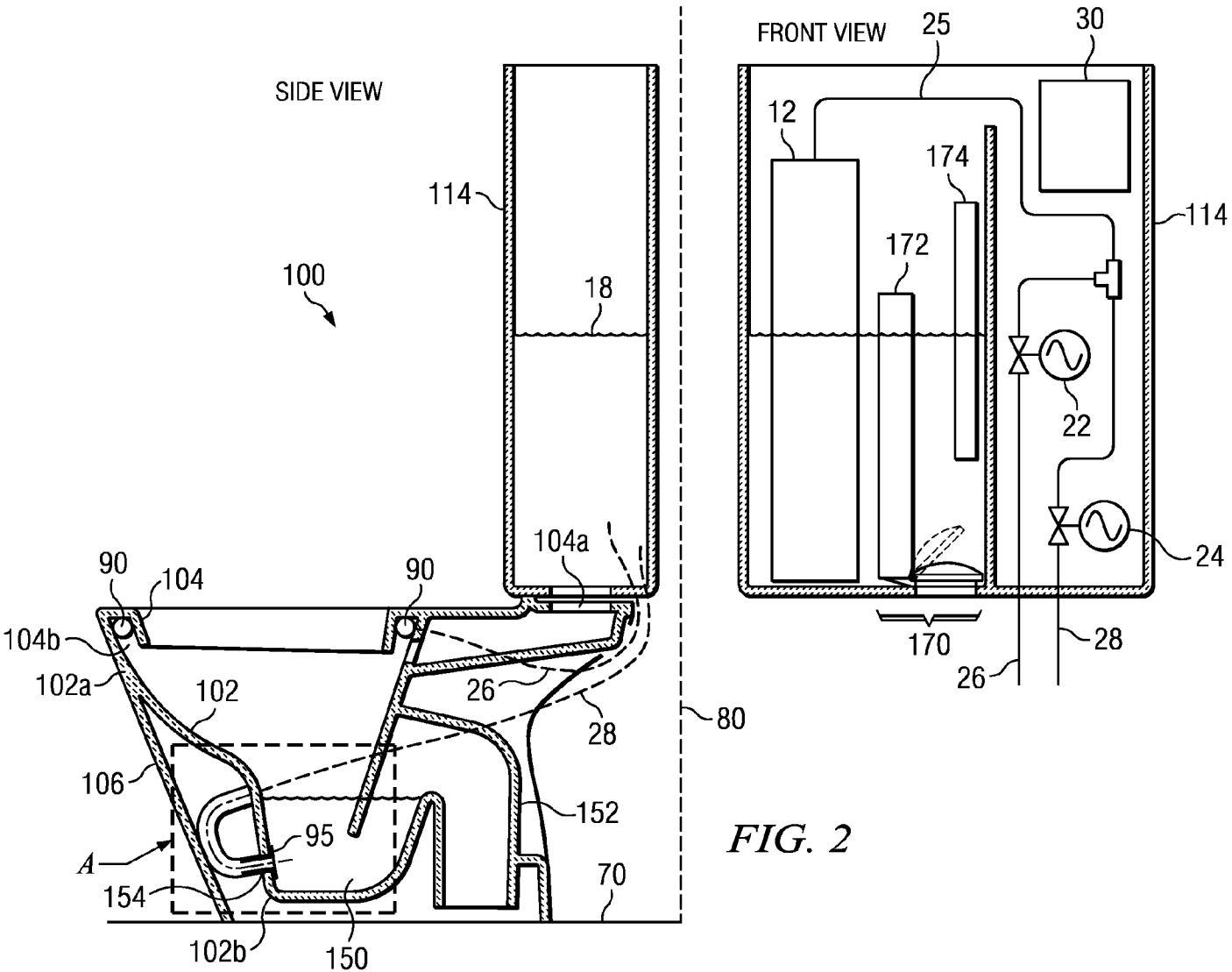
FIG. 2 shows a non-siphoning toilet having a floor-standing bowl with a floor discharge and an above-bowl tank housing a flushing system of the present invention.

Now referring further to the figures, the various toilet embodiments described hereinabove are disclosed in combination with the present invention flushing system. FIG. 2 shows a non-siphoning toilet 100 having a bowl 102 with a rim 104 molded therewith and a skirt 106 that shrouds bowl 102 and optionally forms at least a portion of rim 104 thereby. Rim 104 is disposed at a top bowl extent 102*a* and has a fluid aperture 104*a* defined therein that establishes fluid communication with a water tank 114 disposed adjacent top bowl extent 102*a*. Water tank 114 stores water at a predetermined first volume (see water level 18 in FIG. 1) for delivery of a prescribed water volume to bowl 102 during a flush cycle (for water conservation compliance, up to about 1.6 gallons/6.0 liters is stored). Skirt 106 may be selectively formed as a separate element relative to bowl 102 to accommodate maintenance of the operating elements of toilet 100, as further described hereinbelow.

Figure 2A:
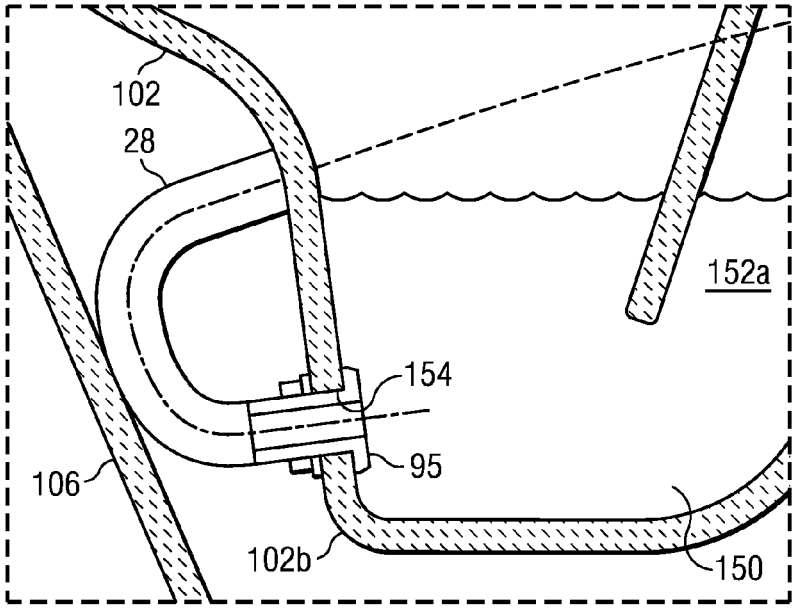
FIG. 2A shows an enlarged view of section A of FIG. 1 wherein a jet delivery means is in fluid communication with a ceramic sump.

A sump 150 defined in a bottom bowl extent 102*b* leads to a trapway or exhaust pipe 152 that delivers water and waste from bowl 102 to an external waste delivery conduit (not shown). To arrange a sufficiently high water exchange rate in bowl 102 during the flush cycle, the amount of water stored in sump 150 is a minimal volume. Sump 150 is therefore deep with a small water spot that does not induce siphoning yet exploits the advantages of a large exhaust pipe (having a typical diameter at or about 6.35 cm (2.5") to 7.62 cm (3"), inclusive, along the extent thereof). Sump 150 has a jet hole 154 located opposite an outlet from sump 150 into exhaust pipe 152 for enhanced waste removal via a jet delivery means (see FIG. 2A). Bottom bowl extent 102*b* is supported on a support surface such as floor 70 outside of wall 80 as shown herein.

Pump 12 is submersed in tank 114, which tank is disposed outside of wall 80. Pump 12 delivers water through pump water delivery conduit 25 to rim diverter means 22 and jet diverter means 24. During the flush cycle, rim diverter means 22 delivers water through an optional rim wash line 90 that is in fluid communication with rim water delivery conduit 26.

Ceramic rim 104 includes an integral channel 104*b* that insertably accommodates rim wash line 90 thereby. Rim wash line 90 desirably comprises a commercially available and adaptable plastic or metal conduit having an unoccluded lumen therethrough. In the alternative, rim wash line 90 may be integrally molded with an inner surface of rim channel 104*b*. Although this latter configuration is more difficult to manufacture, it permits improved tolerance under the rim and thereby obviates accumulation of effluents therein.

Pump 12 also delivers water via pump water delivery conduit 25 to jet diverter means 24 during the flush cycle executed by system 10. Jet diverter means 24 subsequently directs water to jet water delivery conduit 28 for delivery to a jet delivery means such as jet fitting 95 disposed in jet hole 154 (see FIG. 2A). Jet fitting 95 directs flow from jet water delivery conduit 28 into sump 150 for enhanced waste removal through exhaust pipe entrance 152*a*.

Figure 2B:
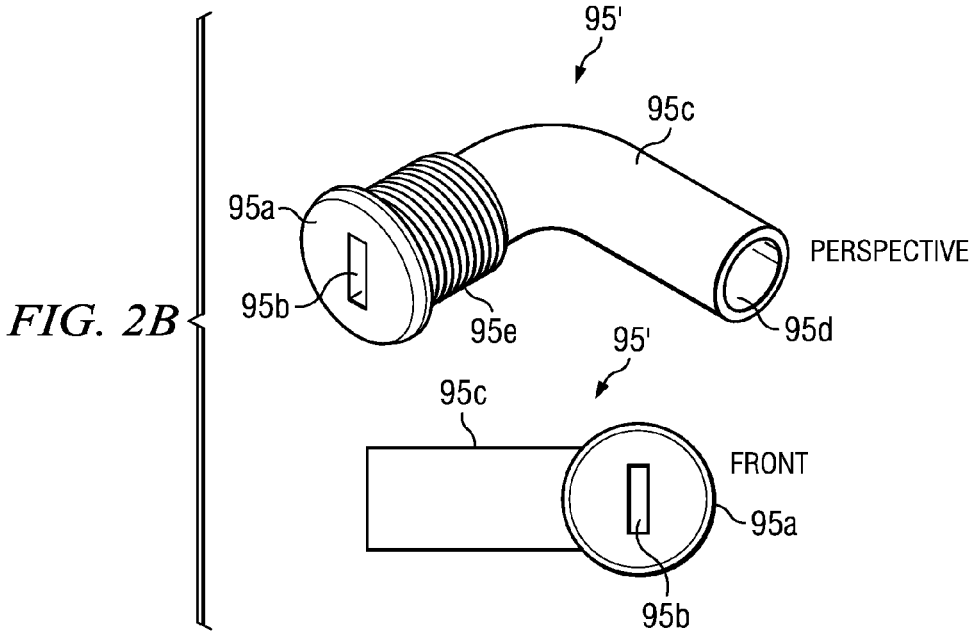
FIG. 2B shows perspective and front views of a jet delivery means used with the present invention.

Jet fitting 95 or an equivalent thereof is desirably incorporated in each of the toilet embodiments described herein. FIG. 2B shows a jet fitting 95' that may be used in jet hole 154. Jet fitting 95' has a face 95*a* directed toward sump 150 with a slot 95*b* of predetermined length and width defined therewithin (for instance, a 100 mm×3 mm may be incorporated in a non-siphoning toilet configuration). Water is delivered through slot 95*b* via a conduit 95*c*, shown herein as an elbow member defining a lumen 95*d* thereby. A threaded region 95*e* may be provided to effect threaded securement with a correspondingly threaded fixation member disposed at or adjacent hole 154 (although other fastening means are contemplated as being used with jet fitting 95' and equivalents thereof). By providing slot 95*b* in the jet fitting, water delivered through the slot spirals through the sump. This spiraling jet wash more advantageously removes water and waste from the sump via increased water velocity.

Timing of water delivery by pump 12 to rim diverter means 22 and jet diverter means 24, and subsequent timing of water delivery by the diverter means to corresponding rim 104 and jet fitting 95 in fluid communication therewith (respectively), is effected by electronic controller 30. The timing of water delivery via rim diverter means 22 and jet diverter means 24 is further described hereinbelow with reference to FIGS. 13(A) to 13(G).

In the event of a power loss, toilet 100 can be flushed by conventional flush means such as a manual flush valve means 170 with an overflow tube 172 and a refill control valve 174. Overflow tube 172 prevents flooding in the event that a power loss or surge negatively effects the flush cycle of system 10. The supplemental integration of manual flush means enhances the inherent function of the gravity forced flush-mechanism, thereby permitting toilet function in the absence of electric power. Although manual flush means 170 is shown with an overflow tube and refill valve in combination, there are numerous other gravity forced flush-mechanisms that are well known for use in gravity forced toilets and appropriate for use with the present electronic system.

Figure 3:
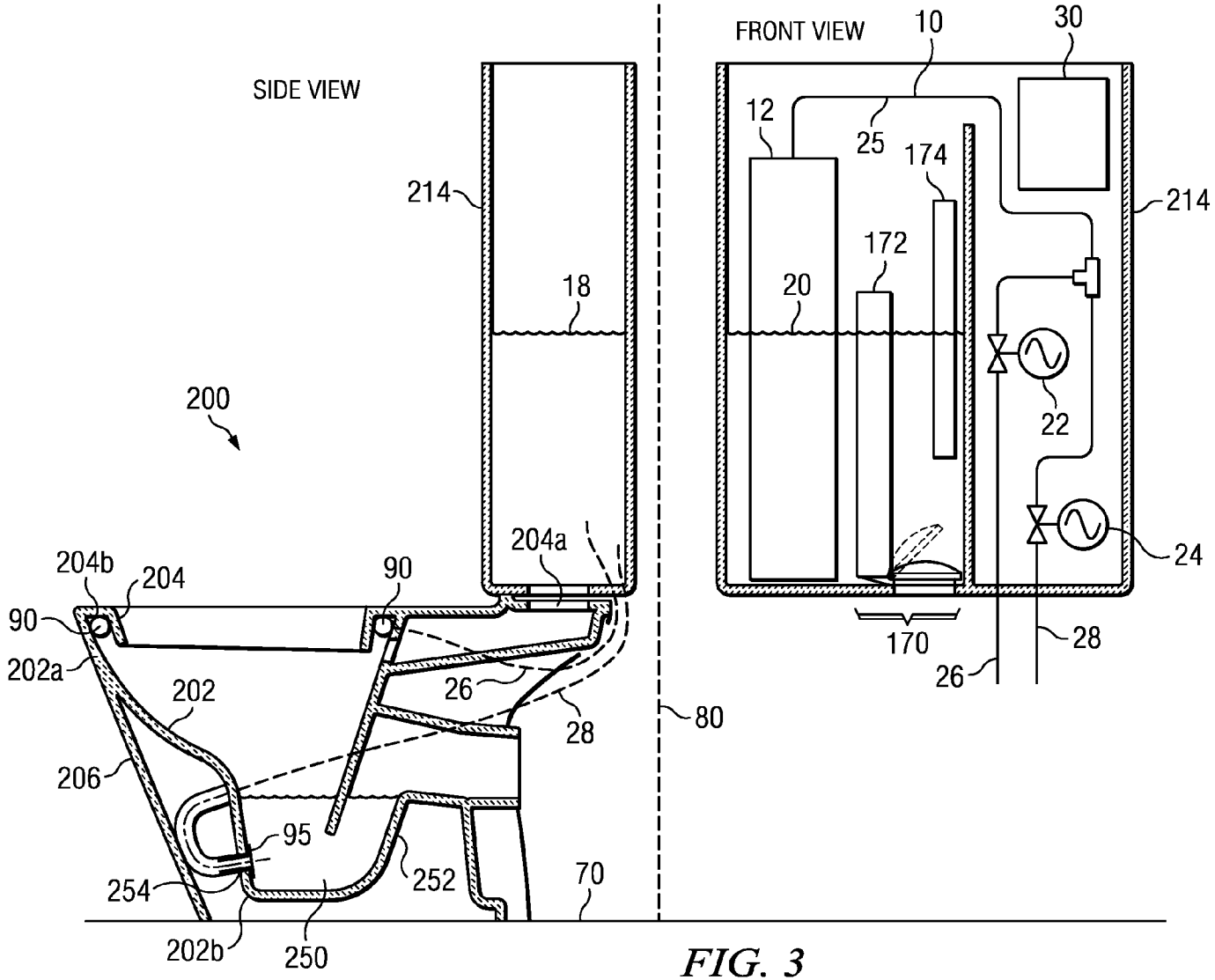
FIG. 3 shows a non-siphoning toilet having a floor-standing bowl with a wall discharge and an above-bowl tank housing a flushing system of the present invention.

FIG. 3 shows a non-siphoning toilet 200 similar to toilet 100 shown in FIG. 2, with similar elements being similarly numbered. Toilet 200, however, has a wall discharge. In accordance with prevailing codes, non-siphoning toilet embodiments can be installed in either of a floor or wall outlet with the tank located in different positions to accommodate preexisting plumbing configurations. Toilet 200 incorporates system 10 as described with reference to the embodiment shown in FIG. 2 and also utilizes the advantages of a manual flushing valve means 170 incorporated in the tank.

Figure 4:
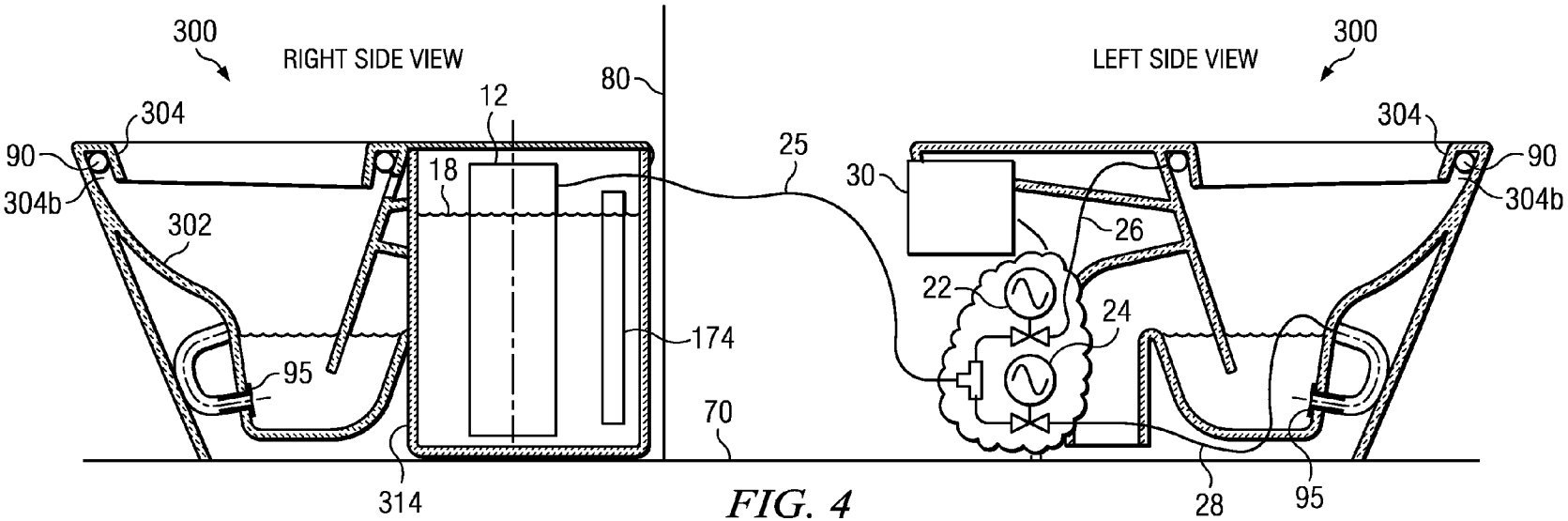
FIG. 4 shows a non-siphoning toilet having a floor-standing bowl with a floor discharge and a tank disposed below the bowl that houses a flushing system of the present invention.

FIG. 4 shows left and right side views of a non-siphoning toilet 300 having a floor drain and also having a tank 314 hidden beneath a bowl 302. In the right side view, it is seen that pump 12 is submersed in tank 314 disposed adjacent floor 70 outside wall 80. In the left side view, rim diverter means 22 and jet diverter means 24 are shown in electrical communication with electrical controller 30 below rim 304. Toilet 300 uses a jet fitting 95 and a rim wash line 90 disposed in rim channel 304*b* as described hereinabove with reference to toilet 100, although the exact configuration of rim wash line 90 and jet fitting 95 can be modified for this toilet configuration.

FIG. 5 shows a wall-hung toilet 400 having a wall discharge wherein a tank 414 is disposed inside wall 80. Toilet 400 has a bowl 402 with a skirt 406 therearound and a rim 404 at a top bowl extent 402*a*. Trapway 452 leads from sump 450 to a preexisting drain line (not shown) disposed in wall 80. In version (a) of toilet 400, tank 414 houses pump 12, rim diverter means 22, jet diverter means 24, electronic controller 30 and manual flush valve means 170 therein. An optional wall is constructed between submersed pump 12 and the remaining electronic components (rim diverter means 22, jet diverter means 24 and electronic controller 30). In version (b) of toilet 400, the manual flush valve means is omitted for an optional compact configuration that still embodies the elements of system 10. The version (a) has an additional tank water delivery conduit that delivers water from 414 to bowl 402 via manual flush means 170.

The present invention benefits all of the aforementioned non-siphoning toilet configurations. The difference between a floor-standing bowl with discharge into the floor and a floor-standing bowl with discharge into the wall is invisible from the outside and typically accommodates the configuration of preexisting drain lines. For the wall-hung model shown in FIG. 5, tank 414 requires installation in wall 80 with tiles formed thereover (thereby moving the wall outward to accommodate placement of the tank therebehind).

Now referring to FIG. 6, wherein like elements are similarly identified, a siphoning toilet 500 is shown. Siphoning toilets differ from their non-siphoning counterparts by having a drain in the floor that creates room behind the bowl where a smooth siphoning exhaust pipe can be installed. When the siphon is arranged by water flow from the jet, it removes all water that is stored in the bowl, and the exchange rate of water in the bowl consequently becomes very high. Therefore, the amount of water stored in the bowl can significantly exceed the amount of water stored in a non-siphoning model by inclusion of a large water spot.

Toilet 500 has a bowl 502 with a rim 504 integral therewith and a skirt 506 shrouding bowl 502, which shroud is selectively integral with one or both of bowl 502 and rim 504 or alternatively formed as a separate element. A tank 514 is disposed adjacent a top bowl extent 502*a* so as to establish fluid flow with bowl 502 via rim aperture 504*a* (tank 514 generally stores about or less than about 1.6 gallons/6.0 liters in compliance with prevailing water consumption regulations). A sump 550 is defined in bowl 502 and has a jet hole 554 defined thereadjacent for delivery of a jet to a trapway or exhaust pipe 552 (the configuration of jet hole 554 is similar to that of jet hole 154 shown in FIG. 2A). Bottom bowl extent 502*b* is supported on floor 70 outside wall 80 such that tank 514 remains outside the wall. Tank 514 houses submersible pump 12, rim diverter means 22, jet diverter means 24 and electrical controller 30 therein. Tank 514 optionally houses a manual flush valve means therein (such as manual flush valve means 170 described hereinabove) to release water overflow in the event of power failure. Jet fitting 95 disposed at or adjacent sump 550 delivers a water jet to a trapway ingress 552*a* to assist in the toilet's siphoning function.

Figure 7:
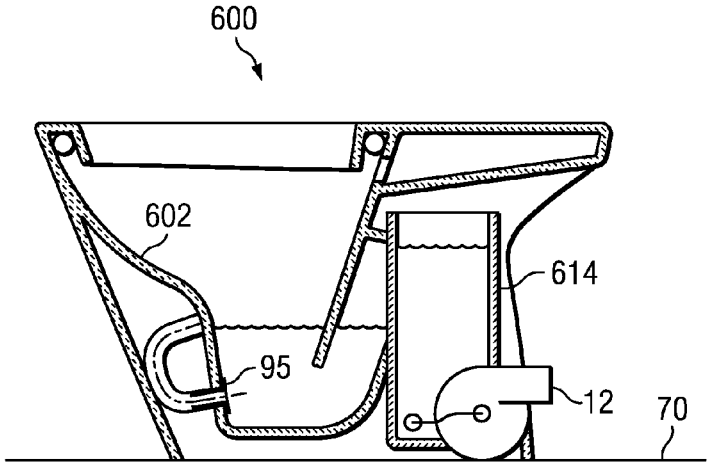
FIG. 7 shows an alternative toilet with a floor drain that integrates the flushing system of the present invention such that a pump thereof is not submersed in water that is stored in a toilet tank.
Figure 8:
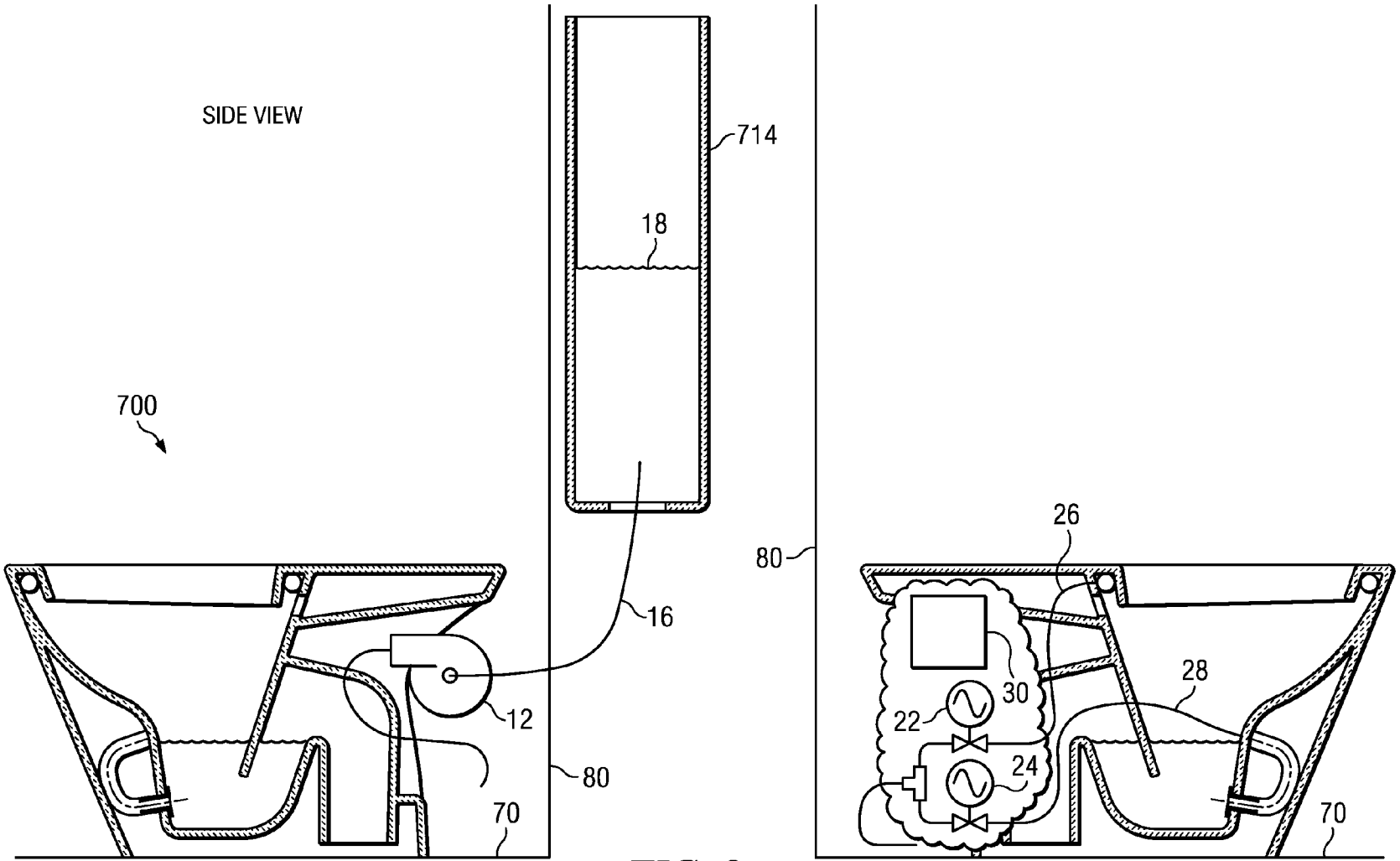
FIG. 8 shows a substantially similar toilet to that shown in FIG. 7 except that the tank thereof is disposed inside of a wall.

FIG. 7 shows a non-siphoning toilet 600 with a floor drain that integrates system 10 beneath a bowl 602 so that pump 12 is not submersed in water stored in a tank 614. FIG. 8 shows a substantially similar toilet 700 except that a tank 714 thereof is disposed inside wall 80.

Figure 9:
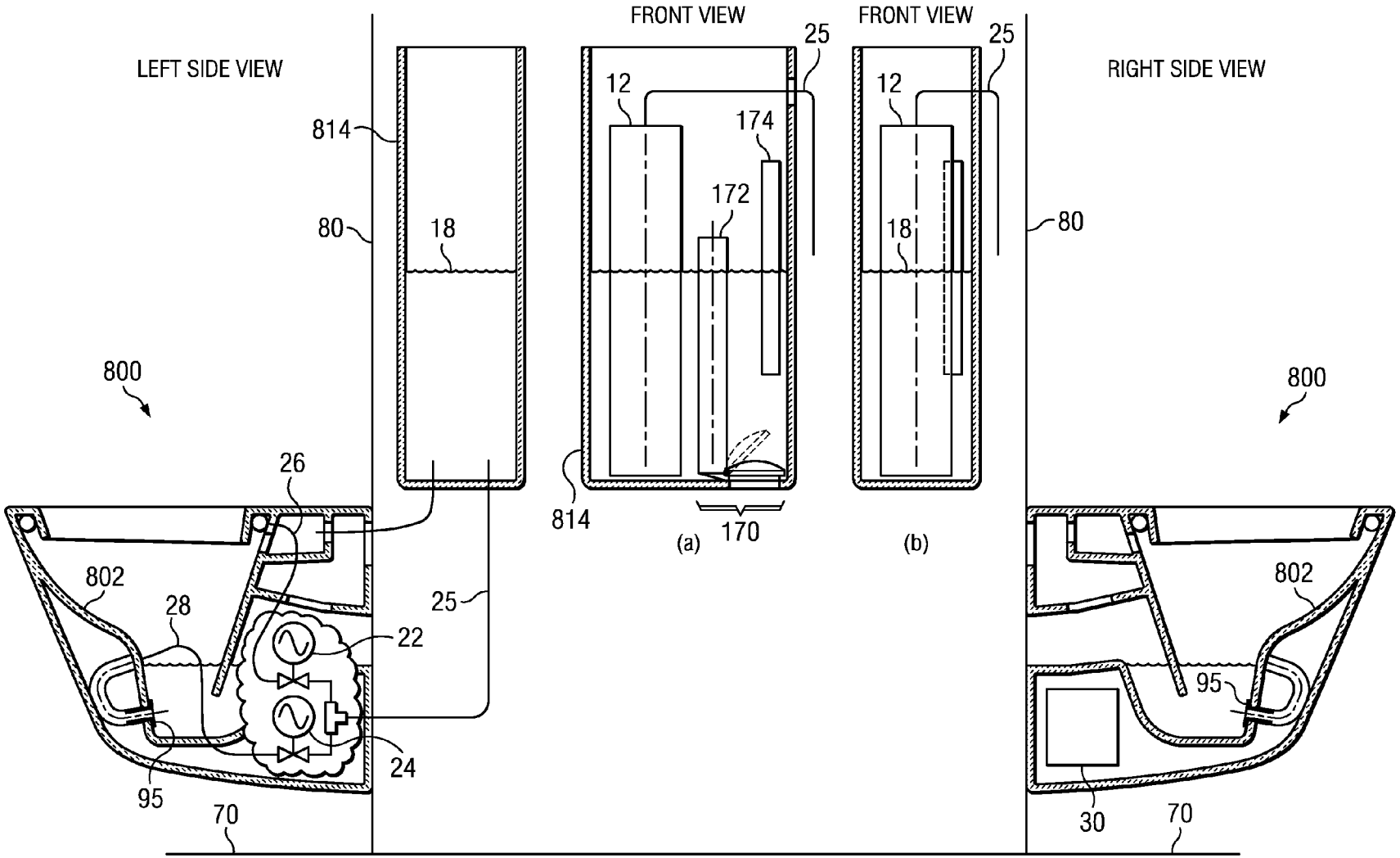
FIG. 9 shows an alternative wall-hung toilet having an in-wall tank that houses a pump of the flushing system of the present invention and wherein the rest of the system is disposed under a toilet bowl.

FIG. 9 shows an alternative wall-hung toilet 800 having an in-wall tank 814 and pump 12 submersed in the water stored at water level 18 therein. Rim diverter means 22, jet diverter means 24 and electronic controller 30 are stored beneath a bowl 802. In version (a) of toilet 800, pump 12 is selectively submersed in the tank water with a manual flush valve means (such as manual flush valve means 170 described hereinabove). This manual flush valve means is omitted in version (b). An additional fluid delivery conduit 16' establishes fluid communication between the manual flush means in tank 814 and bowl 802.

Figure 10:
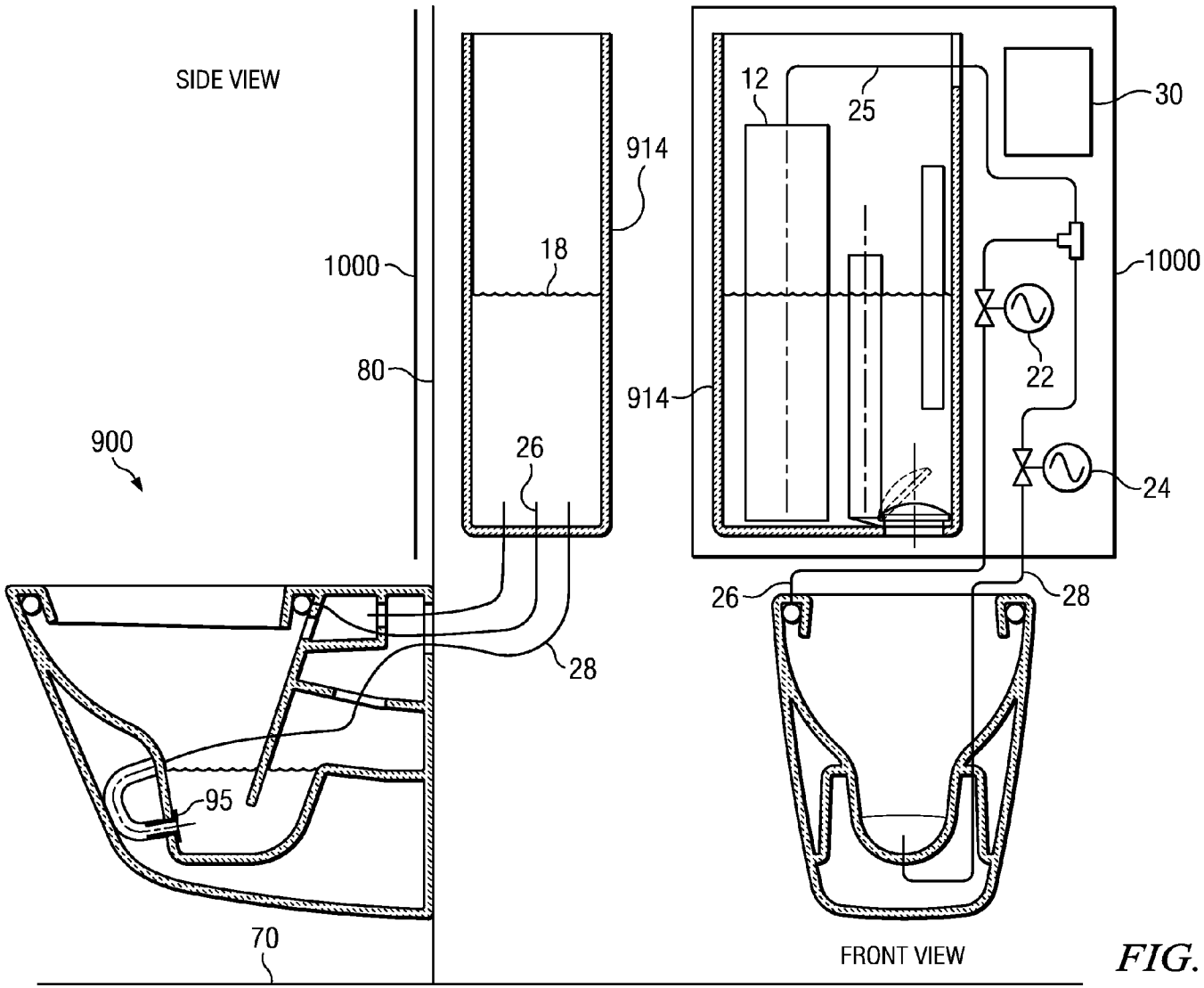
FIG. 10 shows another alternative embodiment of a wall-hung toilet having an in-wall tank that houses the flushing system of the present invention.

FIG. 10 shows another embodiment of a wall-hung toilet 900 with an in-wall tank 914 housing submersed pump 12 and a manual flush valve means. Rim diverter means 22, jet diverter means 24 and electronic controller 30 are disposed outside of tank 914 but within wall 80. An easily removable cover 1000 is provided in or adjacent wall 80 to permit easy access to system 10 and tank 914 without destruction of the wall.

Figure 11A:
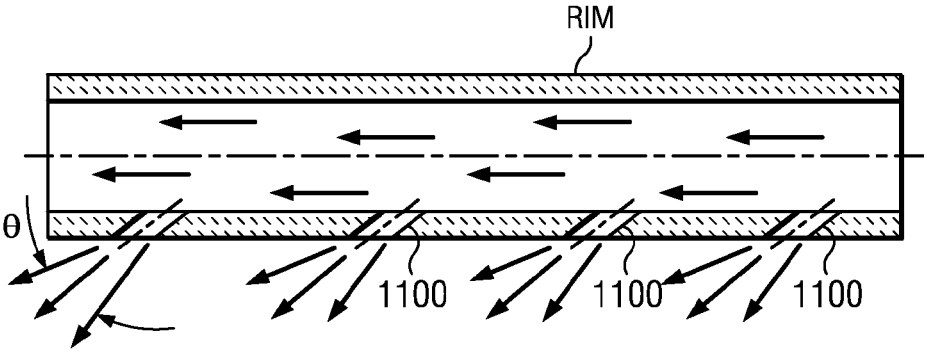
FIG. 11(*a*) shows an enlarged partial view of a water flow path through a toilet rim portion having a plurality of spray apertures provided therein.
Figure 11B:
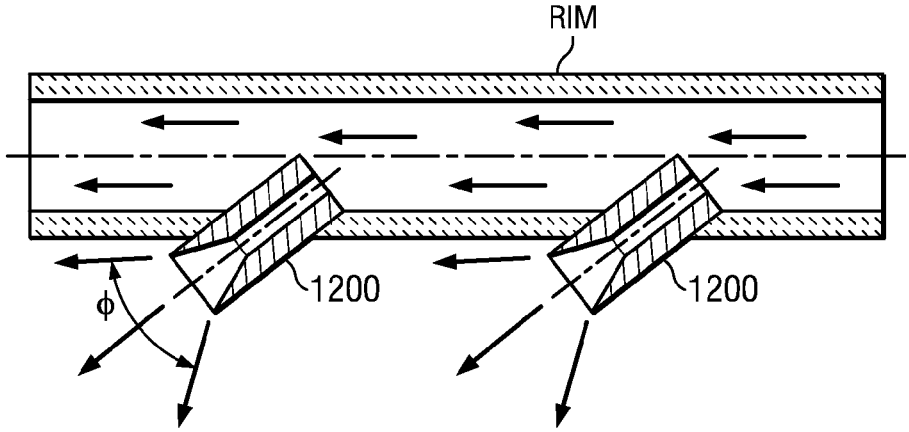

In all of the aforementioned toilet embodiments, a spray means desirably delivers pressurized water into the bowl for efficient cleaning thereof. Such spray means may comprise at least one aperture 1100 integrally molded into the toilet rim as shown in FIG. 11(*a*). Aperture 1100 may comprise a portion of a plurality of apertures disposed in a predetermined pattern at or proximate the toilet rim. The center line angle θ of each aperture 1100 is at a predetermined oblique angle in the range from about 37° to about 45° inclusive to achieve a spray sufficient for optimal coverage of the bowl interior (although 45° is preferred).

In the alternative, one or more nozzles 1200 may be employed as shown in FIG. 11(*b*). Employment of spray nozzles 1200 to direct water onto the bowl interior requires proper orientation thereof to prevent splashing. The most preferred type of spray pattern is a flat fan spray with a wide angle ϕ at a predetermined oblique angle in the range from about 50° to about 70° (although 65° is preferred). To prevent intersecting sprays, consecutively disposed spray nozzles 1200 are oriented at an angle relative to vertical, and the fan surface of the spray should be tangent to the bowl interior. In this way, the sprays form a vortex and thereby avoid intersection and consequent splashes produced thereby. As seen in FIG. 11(*b*), the centerline of each spray nozzle 1200 is therefore optimally oriented at an angle that is sufficient to achieve complete removal of the pen stain (desirably at or about 37° to vertical).

Proper orientation of spray apertures 1100 and spray nozzles 1200 overcomes the deficiencies of conventional toilets that utilize one or more sprays for flushing and/or cleaning. At the beginning of a flush cycle in such conventional arrangements, rim sprays are actuated when the bowl is still full of water and waste. These sprays are directed into the bowl and create splashes, and they cannot reach the underwater area of the bowl to directly clean waste surface markings. It is therefore advantageous to delay rim action until the moment when the bowl is empty, as realized by the present invention.

Figure 12A:
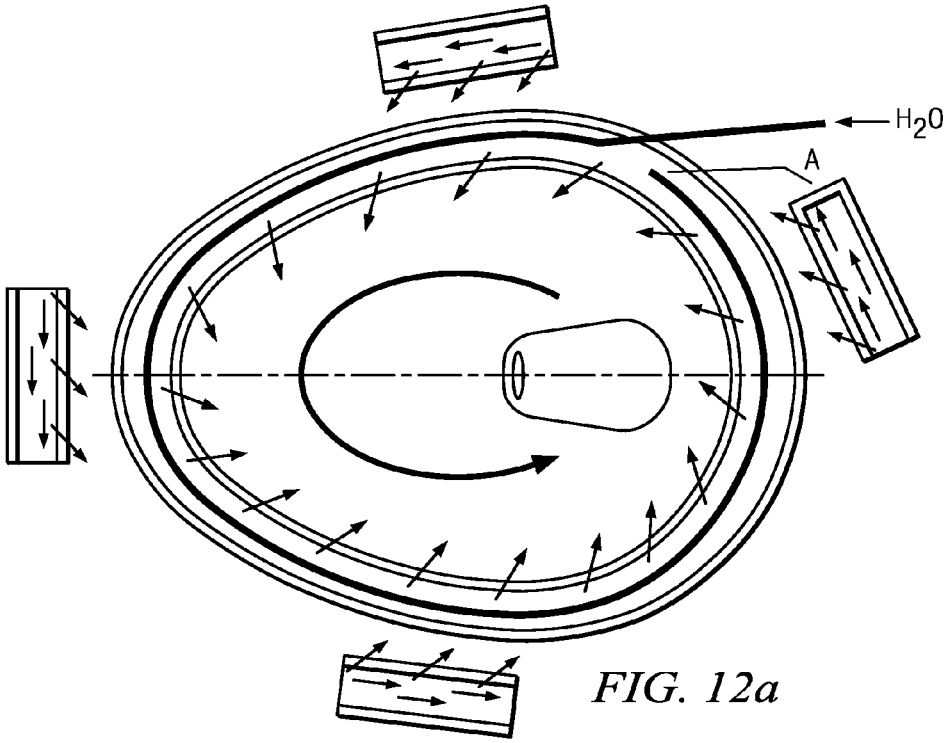
FIG. 12(*a*) shows a rim water delivery path achieved upon direct securement of a rim water delivery conduit to a rim channel in fluid communication therewith.
Figure 12B:
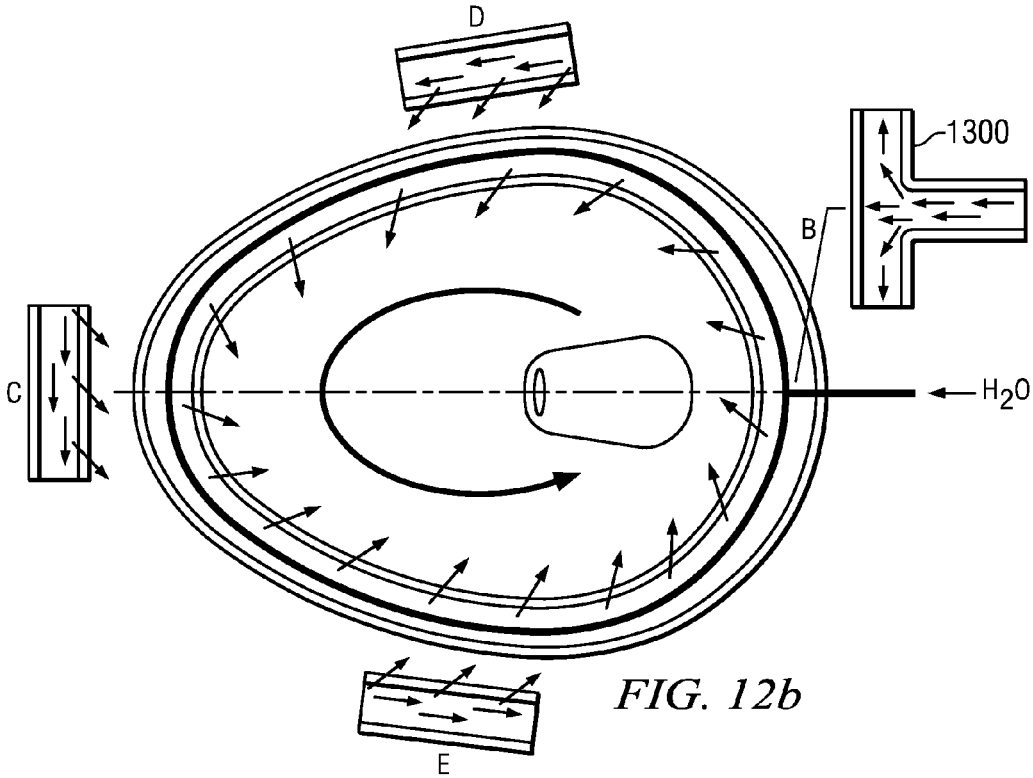

In each of the aforementioned embodiments, rim water delivery conduit 26 establishes fluid communication between the rim channel and rim diverter means 22. Referring to FIGS. 12(*a*) and 12(*b*), rim water delivery conduit 26 can be secured directly along a rim channel such as rim channel 104*b* shown in FIG. 2 (see FIG. 12(*a*)), or alternatively through a connector such a bifurcated tee connector 1300 (see FIG. 12(*b*)). In the former embodiment, supply of water through the rim at one entry point incurs fewer hydraulic losses then supply through the latter embodiment. If water travels in a unidirectional path along the rim channel, the direction of flow in the channel is in agreement with the direction of every elementary flow from each spray hole or nozzle defined in the rim. The channel flow thereby halts only at the termination of the flow path (see point A, FIG. 12(*a*)). In the latter embodiment, water flow through tee connector 1300 halts at the bifurcation point (see point B, FIG. 12(*b*)). Subsequently, water flow stops at a point where branches of flow meet at a location opposite the bifurcation point (see point C, FIG. 12(*b*)), creating at least two opportunities for hydraulic losses. Along the first half of the flow path, flow in the rim channel is in agreement with the direction of elementary flow from each hole or nozzle (see point D, FIG. 12(*d*)). Along the second half of the flow path, however, the water flow assumes a sharp turn and therefore exits spray apertures 1100 or spray nozzles 1200 with reduced energy (see point E, FIG. 12(*b*)). Either flow path configuration may be employed, however, to complement the pump function and provide maximum options for installation and operation.

In operation, any of the aforementioned toilet embodiments may be initially connected to an existing water supply line for delivery of water to the tank up to tank water line 18. The sump is also filled with water to create a water seal between the sewer line (not shown) and ambient air (as is well known in the art). At this point, the sump is ready to accept liquid and solid waste. Sensor means 20 detects whether there is enough water in the tank for a sufficient flushing operation, thereby ensuring that pump 12 does not run dry. Sensor 20 may optionally communicate with an indicator light, audible tone or equivalent means to notify the user that the toilet and flushing system are ready for use. Electric power supply member 32 connects system 10 to a readily available electric supply line.

The schedule of the flushing cycle is very important for proper operation of the present invention, as demonstrated by the time schedules shown in FIGS. 13(A) to 13(G). The major difference between the present invention toilet flushing system and conventional flushing systems is the inherently strict control of high pressure rim and jet flows and, particularly, the timing and direction thereof.

For liquid and/or light solid waste removal, the flushing system of the present invention can effect a single flush schedule via actuation of single flush activation switch 36. Activation of switch 36 initiates operation of pump 12 and opens jet diverter means 24 for delivery of water to jet water delivery conduit 28. Water travels from tank water delivery conduit 16 to pump 12, from pump 12 to pump water delivery conduit 25, from pump water delivery conduit 25 to jet diverter means 24, from jet diverter means 24 to jet water delivery conduit 28 and finally from jet water delivery conduit 28 to a jet delivery means (such as jet fitting 95). A strong jet spray pushes water and load out of the sump to the exhaust pipe for eventual disposal in the drain line. When the sump is empty, electronic controller 30 ceases operation of the jet spray controlled by jet diverter means 24 so as to avoid creation of undesirable splashes and/noise. Pump 12 continues to run, and jet diverter means 24 closes. Simultaneously, rim diverter means 22 opens and directs flow to rim water delivery conduit 26 and the rim channel for terminal delivery through the spray means (such as spray apertures 1100 or spray nozzles 1200) provided in the rim. When the bowl is empty, sprays from the spray means directly contact the interior surface the bowl without contacting the stored water in the sump, thereby ensuring optimum cleanliness. This flush cycle therefore removes initially stored water and any kind of load out from the bowl, cleans the walls of the bowl and refills the bowl to restore the water trap.

Figure 13A:
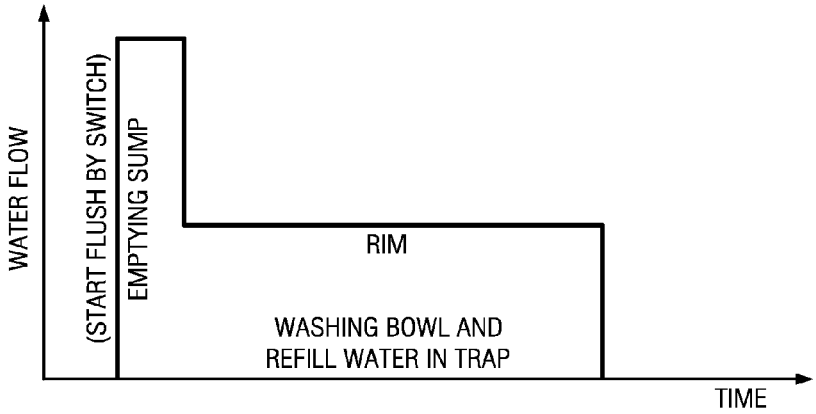
FIGS. 13(A) to 13(G) show alternative time schedules for operation of the flushing system of the present invention in multiple toilet embodiments.
Figure 13B:
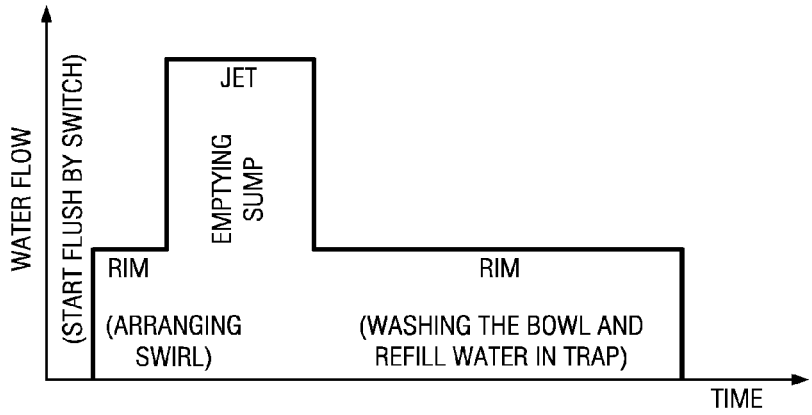

For an extended single flush schedule for liquid and/or solid waste removal, the effectiveness of solid waste and/or paper removal is significantly improved if, during the above described economy flush cycle, a small water volume is directed into the rim. In this improvement, an initial, small first spray from the rim pushes down into the sump, thereby removing solid waste and/or paper that can stick to the bowl interior. The subsequent jet flow pushes the collected residue directly into the exhaust pipe. This cycle uses only slightly more water (about 0.8 gallons (0.3 liters)) than the previously described single flush cycle. The timing schedule for the single flush schedule is shown in FIG. 13(A) (FIG. 13(B) shows a modified single flush schedule wherein the difference is the extended duration of the last rim action subsequent to emptying of the sump). Because of the present invention's high water use efficiency, the single flush cycle water consumption is limited to at or about 0.53 to 0.79 gallons (2 to 3 liters), inclusive, for both liquid and solid waste removal. The duration of this single cycle is about 2 to 3 seconds.

Figure 13C:
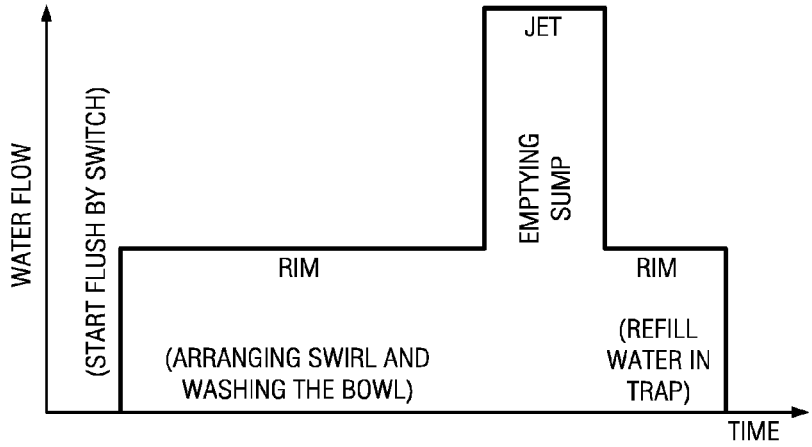
Figure 13D:
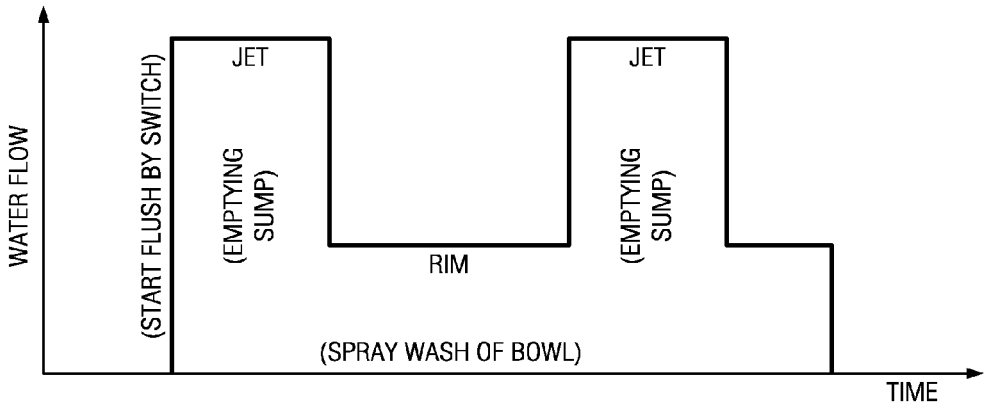

For removal of solid waste, the flushing system of the present invention can effect an economy dual flush schedule via actuation of dual flush activation switch 38. Switch 38 can be actuated via manual or touchless means as described above with reference to switch 36. Each dual flush cycle comprises two elementary single flushes shown in FIGS. 13(C) and 13(D) (FIG. 13(C) shows the economy dual flush schedule executed for a non-siphoning style bowl, and FIG. 13(D) shows this schedule for a siphoning bowl). It is understood that triple cycles can also be implemented.

After the first single cycle, some residual waste and paper can remain in the sump. Also, water from the spray means that removes surface markings from the bowl interior may retain undesirable residual waste, creating a potentially unhygienic appearance in the sump water. The second cycle therefore removes the sump refill water that accumulated during the first cycle. FIGS. 13(C) and 13(D) show cycles with initial jet flow followed by emptying of the sump. Rim flow follows with bowl cleaning and the jet flow is repeated with emptying of the sump. Rim flow is subsequently repeated with bowl cleaning and sump refill for restoration of the water trap. Since non-siphoning models require less water for the sump refill, the duration of the last rim action is shorter than that performed for siphoning models, which have a large amount of stored water. Both cycles effect cleaning of the bowl and sump refill by using less than 1.6 gallons (6.0 liters) of water cumulatively. The dual cycle executed by system 10 thereby ensures predictable and repeatable waste removal and cleaning within applicable water consumption limits.

Figure 13E:
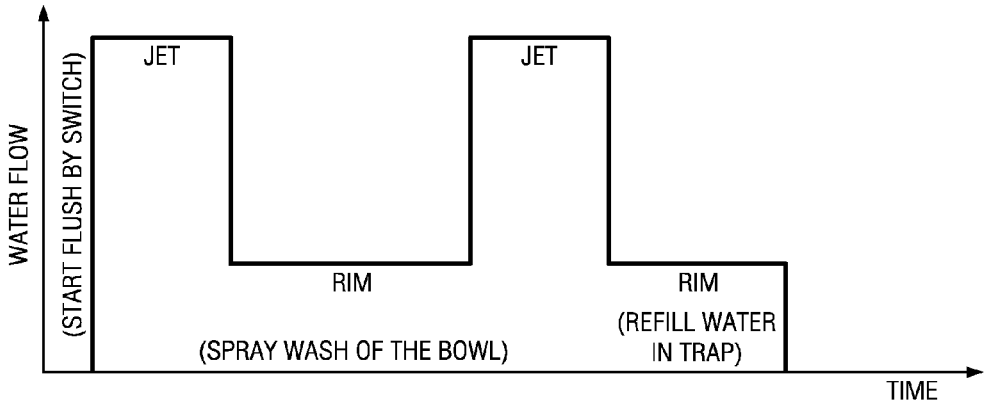
Figure 13F:
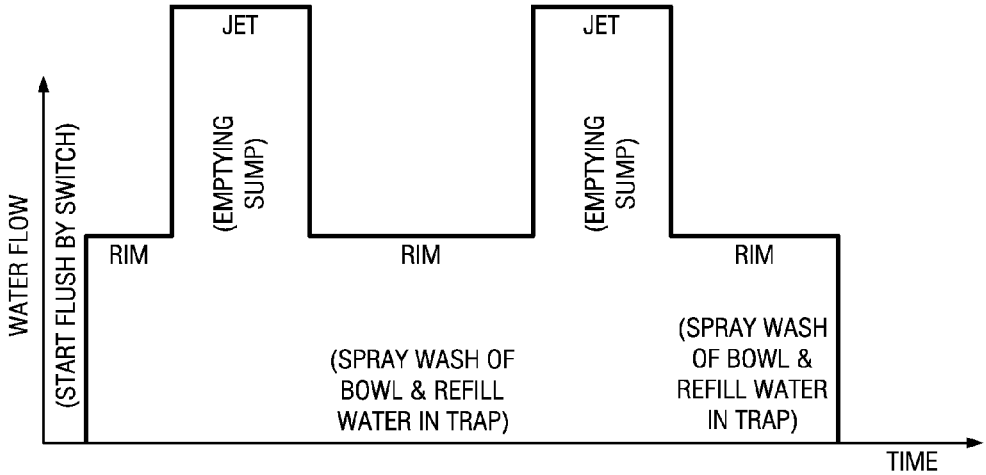
Figure 13G:
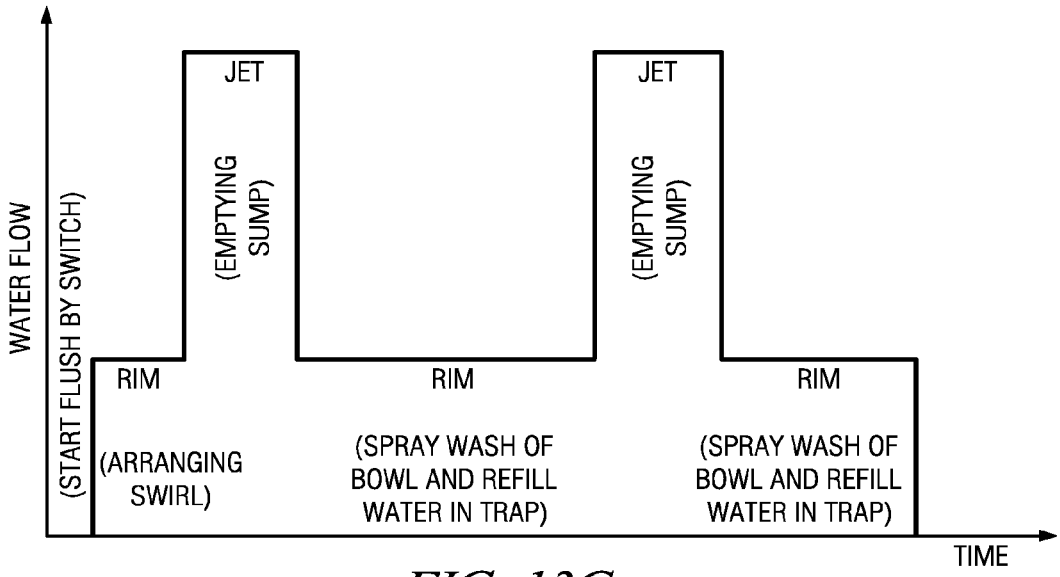

The economy dual flush cycle for removal of solid waste may be modified to a full dual flush cycle for heavy loads by employing slightly more water, yet still remaining within the regulatory limit of 1.6 gallons (6.0 liters). During the first cycle, water is directed first in the rim through spray apertures 1100 or nozzles 1200 to push the load inside the sump and create a vortex thereby. Next, pump 12 is activated to deliver water to a jet delivery means such as jet fitting 95 described hereinabove. Generally rotational motion of water and waste in the bowl is transformed into linear motion in the exhaust pipe. The initial deposit of water from the rim, therefore, optimizes evacuation of heavy loads of solid waste. FIG. 13(E) shows the full dual flush schedule executed for a non-siphoning-style bowl, and FIG. 13(F) shows the schedule for a siphoning bowl (FIG. 13(G) shows a modification in the extended schedule wherein the difference is the extended duration of the last rim action subsequent to emptying of the sump). For solid waste removal in this full dual flush mode, at or about 5 to 6 liters of waters is consumed.

It is therefore evident that the above described flush schedules may be modified in accordance with the environmental operating conditions in which system 10 is employed. By consecutively repeating two or three elementary single flushes within a 1.6 gallon (6.0 liter) limit, optimum flushing results are observed.

Example

A prototype toilet was constructed employing the above described concepts in a siphoning toilet of configuration such as toilet 500 shown in FIG. 6. A clear plastic bowl was constructed with a 2¼" water seal and a water spot of about 10"×8½". Static water volume in the bowl comprised about 0.53 gallons (2 liters). The exhaust pipe assumed a constant diameter of about 2⅝" with a shape identical to that disclosed by Applicant's U.S. Pat. No. 6,728,975 and Applicant's pending application published as U.S. Patent Application Publication No. 2004/0040080 (the entire contents of both disclosures being incorporated by reference herein). The rim was provided with six spray nozzles positioned equidistantly along the periphery thereof. A pair of commercially available solenoid valves was provided for the rim diverter means and the jet diverter means. The storage tank was not under line pressure.

A pump was selected from one of a plurality of commercially available pumps such as pumps sold by Granger having the following parameters: 120V, single phase, 8 A, 60 Hz, 7,000 RPM, ¾" NPT ports, max pressure 52 psi, max flow 22 GPM. For the electronic timers that control operation of the pump and rim and jet diverter means, the resolution was 0.05 seconds.

The tank water delivery conduit was a braided hose of about ¾" diameter. The pump water delivery conduit, rim water delivery conduit and jet water delivery conduit all comprised braided hoses of about ½" diameter. Each of a power supply line and a water supply line were provided in communication with the toilet.

The toilet was tested according to the schedule illustrated in FIG. 13(A) (single flush), and the parameters of operation are as follows:

1. The full duration of the single cycle (i.e., push out load of the bowl/clean the bowl) is 2.7 seconds
2. The pump operates for the entire duration of a single flush (2.7 seconds).
3. The jet operates for 0.7 seconds.
4. The spray nozzles around the rim operate for 2 seconds.

During this operation, the balance of water consumption is as follows:

1. The jet emits 1 liter of water.
2. After emptying the bowl there is 0.5 liters left in the sump. 1.5 liters is needed to refill the sump to the initial volume of 2 liters. Thus, 2.5 liters of water is used in one single cycle (5 liters is used in a dual flush cycle).
3. There is 1 liter remaining which can contribute to water conservation efforts or be implemented in an initial rim rinsing cycle without exceeding the 6 liter limit (see FIG. 14(B)).

Test Results:

Various tests were conducted with this prototype using various loads, including ping-pong balls (to demonstrate siphoning), polypropylene balls, sponges, solid tubes, golf balls and "water wigglers". The test results from this prototype are shown in comparison with test results from conventional toilet flushing systems, as shown in Table 1 below.

TABLE 1

| Test Media | New | Applicant 6L #1 | Applicant 4.8L | Applicant 6L #2 | Competitor 6L #1 | Competitor 6L #2 |
|---|---|---|---|---|---|---|
| 3 Ping-Pong Balls, out | 3 | 3 | — | — | 2-3 | — |
| 100 Polypro Balls, out | 100 | 100 | — | — | 100 | 100 |
| 30 Sponges, out | 30 | 30 | — | — | 18 | 12 |
| Rubber Tubes, Out | 36 | 41 | 30 | 31 | 32 | 22 |
| Napkins | 19 | 15 | 12 | 13 | 18 | 9 |
| Golf Balls, Out | 20 | 22 | 18 | 22 | 18 | — |
| Water-Wigglers, Out | 16 | 16 | — | — | 10 | — |
| Artificial Human Waste, Flushes to Clean wall | 1 | 6-13 | — | — | — | 48, 45 |

The present invention toilet therefore successfully executes a single flush with 0.66 gallons (2.5 liters) of water and a double flush with 1.3 gallons (5 liters). Similar tests conducted in a non-siphoning style bowl produced similar positive test results. Replacement of the spray nozzles with spray apertures has no discernible negative effect on performance.

It is envisioned that the multi-phase, high energy flushing system of the present invention can be combined with one or more other functions that employ the advantages of electricity for optimum waste removal and bowl cleaning. For instance, an electrically controlled dispenser can add soap, deodorant or cleaning chemicals to flushing water (this may be installed in combination with a visual or audible indicator that alerts the user when the dispenser must be refilled). Also, a deodorizing subsystem may be employed that uses an air fan, an air filter and/or a fragrance dispenser to eliminate odors. Such dispensers and deodorizing subsystems are known in the art (see, for example, U.S. Pat. No. 4,389,738 for "Body Part Cleansing Device"; U.S. Pat. No. 5,457,822 for "Device for Dispensing Disinfectant, Cleaning Agent and/or Scent into a Toilet Bowl"; U.S. Pat. No. 6,467,101 for "Toilet Flushing and Cleaning Device"; and U.S. Pat. No. 6,588,026 for "Method of, and Apparatus for, Introducing a Cleaning Agent and/or Disinfectant into Sanitary Facilities").

For superior waste removal and cleaning functions, the present invention employs plastic or metal conduits for the transport of pressurized water. In conventional toilet cleaning systems, direct application of pressurized water to a ceramic bowl surface can incur defects in the ceramic structure (and thereby deleteriously affect the structural integrity of the bowl). In addition, the creation of uniformly smooth ceramic channels is quite difficult. Implementation of commercially available and readily adaptable conduits eliminates the extensive design and manufacturing effort associated with integration of smooth ceramic channels during the molding process.

Use of electricity in toilet flushing systems not only requires consideration of the water volume usage restrictions in the toilet operating region, but also the limitation of available power in electrical outlets (15 A at 120V for the United States and 15 A at 220V for Europe). The toilet of the present invention will therefore be readily operated within a residential electrical outlet within prescribed regional limits.

The present invention therefore employs an efficient method of employing a water conservation flushing system in a plurality of toilet embodiments. The present inventive flushing system operating method uses minimal water volumes to achieve an effective flush and simultaneously attain optimal bowl cleanliness. By employing the benefits of electrical components, the present inventive method provide a toilet flushing system that significantly reduces consumption of potable water and preserves enhanced toilet sanitation. Such a system can be integrated into multiple siphoning and non-siphoning toilet embodiments for advantageous employment of the inventive method in a plurality of aesthetic designs.

Various changes to the foregoing described and shown structures are now evident to those skilled in the art. The matter set forth in the foregoing description and accompanying drawings is therefore offered by way of illustration only and not as a limitation. Accordingly, the particularly disclosed scope of the invention is set forth in the following claims.

What is claimed is:

1. A flushing system for efficient waste removal from and cleaning of a toilet bowl, said toilet bowl having a bowl with a rim disposed at a top bowl extent and a sump defined in a bottom bowl extent that leads to an exhaust pipe, said sump having a jet delivery means proximate said sump, and said bowl being in fluid communication with a water storage tank having a first predetermined volume of water stored therein, said flushing system comprising:

a pumping means for delivering water from said tank to at least one of a rim diverter means and a jet diverter means in fluid communication therewith;

a sensor means for detecting when said water is at a volume below said first predetermined volume and producing a signal in response thereto;

a control means for controlling at least one of said pumping means, said rim diverter means and said jet diverter means in response to said sensor means;

a switching means for initiating an at least single flush schedule for removal of water and waste from said bowl upon actuation thereof; and a spray means provided at or adjacent said rim for delivering said water to said bowl;

wherein the control means is configured for activating said switching means to initiate said at least single flush schedule, wherein said at least single flush schedule comprises initiating operation of said pumping means, opening said jet diverter means for delivery of water to the jet delivery means in fluid communication therewith, and subsequently closing said jet diverter means upon emptying of said sump and simultaneously opening said rim diverter means and directing water from said rim diverter means to said rim in fluid communication therewith for terminal delivery of said water through said spray means.

2. A flushing system according to claim 1, wherein said switching means comprises a single flush activation switch that initiates operation of said pumping means and opens said jet diverter means for delivery of water to a jet water delivery conduit in fluid communication with said jet diverter means.

3. A flushing system according to claim 2, wherein said jet delivery means is disposed in said bowl so as to push water and waste from said sump to said exhaust pipe.

4. A flushing system according to claim 3, wherein said jet delivery means comprises at least one jet fitting disposed proximate said sump.

5. A flushing system according to claim 4, wherein said at least one jet fitting has a face adjacent said with a slot of predetermined length and width defined therewithin.

6. A flushing system according to claim 5, wherein said slot is at or about 100 mm×3 mm.

7. A flushing system according to claim 1, wherein the controller is further configure for activating said switching means to initiate a preliminary rim washing step wherein a second predetermined water volume is directed into said rim prior to initiation of said at least single flush schedule, said predetermined water volume being less than said first predetermined water volume.

8. A flushing system according to claim 1, wherein said switching means comprises a dual flush activation switch that initiates said at least single flush schedule.

9. A flushing system according to claim 8, wherein said at least single flush schedule comprises an economy dual flush cycle during which said at least single flush schedule is performed at least two times.

10. A flushing system according to claim 9, wherein the controller is further configure for activating said switching means to initiate a preliminary rim washing step wherein a third predetermined water volume is directed into said rim prior to initiation of said economy dual flush cycle, said predetermined water volume being less than said first predetermined water volume and greater than or equal to said second predetermined water volume.

11. A flushing system according to claim 1, wherein said first predetermined water volume is at or less than about 1.6 gallons (6.0 liters).

12. A flushing system according to claim 1, wherein said jet diverter means and said rim diverter means comprise at least one solenoid valve.

13. A flushing system according to claim 1, wherein said switching means is activated by one of a manual actuation member or touchless activation means.

14. A flushing system according to claim 13, wherein said touchless activation means is selected from one of voice recognition means, heat sensor means, motion sensor means, infrared means, radar means, radio frequency means and equivalents thereof.

15. A flushing system according to claim 1, wherein said flushing system further comprises manual flush valve means.

16. A flushing system according to claim 15, wherein said manual flush valve means comprises a refill control valve and an overflow tube.

17. A flushing system according to claim 1, wherein said spray means comprises at least one spray aperture integral with said toilet rim.

18. A flushing system according to claim 17, wherein said at least one spray aperture forms part of a predetermined pattern of spray apertures disposed at or adjacent said rim.

19. A flushing system according to claim 18, wherein a center line angle of each said spray aperture is arranged at an oblique angle relative to said rim.

20. A flushing system according to claim 19, wherein a center line angle of each said spray aperture is from about 37° to about 45° inclusive.

21. A flushing system according to claim 20, wherein a center line angle of each spray aperture is at or about 45°.

22. A flushing system according to claim 1, wherein said spray means comprises at least one spray nozzle disposed at or adjacent said rim so as to direct said water into said bowl.

23. A flushing system according to claim 22, wherein said at least one spray nozzle provides a flat fan spray at a predetermined angle from about 50° to about 70°.

24. A flushing system according to claim 23, wherein said at least one spray nozzle provides a flat fan spray at a predetermined angle at or about 65°.

25. A flushing system according to claim 23, wherein a center line angle of each said at least one spray nozzle is at or about 37° relative to vertical.

* * * * *